US012270188B2

(12) United States Patent
Hashimoto et al.

(10) Patent No.: US 12,270,188 B2
(45) Date of Patent: Apr. 8, 2025

(54) FLUSH TOILET

(71) Applicant: TOTO LTD., Kitakyushu (JP)

(72) Inventors: Hiroshi Hashimoto, Kitakyushu (JP); Kenichi Nakamura, Kitakyushu (JP); Shinichi Urata, Kitakyushu (JP); Kazunari Yasui, Kitakyushu (JP); Isami Sakaba, Kitakyushu (JP); Yuichi Tsubone, Kitakyushu (JP); Shigeru Okada, Kitakyushu (JP); Satoshi Yamazaki, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 187 days.

(21) Appl. No.: 17/931,011

(22) Filed: Sep. 9, 2022

(65) Prior Publication Data

US 2023/0100206 A1 Mar. 30, 2023

(30) Foreign Application Priority Data

Sep. 30, 2021 (JP) ..... 2021-161228
Sep. 30, 2021 (JP) ..... 2021-161231
Sep. 30, 2021 (JP) ..... 2021-161232

(51) Int. Cl.
*E03D 11/08* (2006.01)
*E03D 11/13* (2006.01)

(52) U.S. Cl.
CPC ..... *E03D 11/08* (2013.01); *E03D 11/13* (2013.01)

(58) Field of Classification Search
CPC ..... E03D 11/13; E03D 11/08
See application file for complete search history.

(56) References Cited

U.S. PATENT DOCUMENTS 11,384,521 B2 * 7/2022 Nakamura ..... E03D 11/08
2012/0284911 A1 11/2012 Kamiya et al.
(Continued)

FOREIGN PATENT DOCUMENTS

CN 112523319 A 3/2021
EP 0686731 A1 12/1995
(Continued)

OTHER PUBLICATIONS

"Notice of Reasons for Refusal" Office Action issued in JP 2021-161231; mailed by the Japanese Patent Office on Jan. 7, 2025.
(Continued)

*Primary Examiner* — Erin Deery
(74) *Attorney, Agent, or Firm* — Studebaker Brackett PLLC

(57) ABSTRACT

A flush toilet includes a bowl including a waste receiving surface, a rim and a well portion; a water spouting part that spouts flush water toward the bowl; and a water discharge trap including an inlet connected to a lower part of the well portion, the water discharge trap discharging waste in the bowl, the well portion includes a bottom wall formed above and in front of the inlet of the water discharge trap, a side wall formed to surround a periphery of the bottom wall, and a joining portion that joins an outer edge of the bottom wall and a bottom edge of the side wall with a surface having a curvature, and the bottom wall of the well portion includes a concave portion formed to recess downward on left and right sides with respect to a center axis in a left-right direction in a front sectional view.

13 Claims, 17 Drawing Sheets

(56) References Cited

U.S. PATENT DOCUMENTS

| | | | |
|---|---|---|---|
| 2015/0082531 | A1 | 3/2015 | Kashirajima et al. |
| 2017/0241119 | A1 | 8/2017 | Matsuo et al. |
| 2017/0370085 | A1 | 12/2017 | Cummings et al. |
| 2019/0345707 | A1 | 11/2019 | Kuroki et al. |
| 2021/0095453 | A1 | 4/2021 | Nakamura et al. |
| 2022/0412065 | A1 | 12/2022 | Jiang et al. |

FOREIGN PATENT DOCUMENTS

| | | | |
|---|---|---|---|
| JP | H03-212528 | A | 9/1991 |
| JP | H07-189324 | A | 7/1995 |
| JP | H08-120741 | A | 5/1996 |
| JP | 2001-026960 | A | 1/2001 |
| JP | 2011-174363 | A | 9/2011 |
| JP | 2015-067954 | A | 4/2015 |
| JP | 2015-068126 | A | 4/2015 |
| JP | 2015-206179 | A | 11/2015 |
| JP | 2016-098491 | A | 5/2016 |
| JP | 2017-145631 | A | 8/2017 |
| JP | 2018-105006 | A | 7/2018 |
| JP | 2020-051052 | A | 4/2020 |
| JP | 2020-051053 | A | 4/2020 |
| JP | 2020-051054 | A | 4/2020 |
| JP | 2021-025225 | A | 2/2021 |
| JP | 2021-055437 | A | 4/2021 |
| JP | 2021-085302 | A | 6/2021 |
| JP | 2021-134634 | A | 9/2021 |

OTHER PUBLICATIONS

"Notice of Reasons for Refusal" Office Action issued in JP 2021-161232; mailed by the Japanese Patent Office on Jan. 9, 2025.
"Notice of Reasons for Refusal" Office Action issued in JP 2021-161228; mailed by the Japanese Patent Office on Feb. 3, 2025.

* cited by examiner

FLUSH TOILET

This application claims benefit of priority to Japanese Patent Applications No. 2021-161228, filed on Sep. 30, 2021, No. 2021-161231, filed on Sep. 30, 2021, No. 2021-161232, filed on Sep. 30, 2021, the entire content of which is incorporated herein by reference.

BACKGROUND OF THE INVENTION

Field of the Invention

The present invention relates to a flush toilet, and more particularly, to a flush toilet which is flushed with flush water to discharge waste.

Description of the Related Art

Conventionally, as a flush toilet which is flushed with flush water to discharge waste, there is known, for example, as described in Patent Document 1 (Japanese Patent Laid-Open No. 2015-67954), a flush toilet in which a toilet main body includes a bowl, and a water discharge trap having an inlet connected to a lower part of this bowl.

In such a conventional flush toilet, the bowl of the toilet main body includes a waste receiving surface having a bowl shape, and a well portion disposed below the waste receiving surface to form a pooled water portion by storing a predetermined amount of pooled water.

In this configuration, flush water discharged to the waste receiving surface of the bowl flows into the well portion below the surface and collides with a bottom surface of the well portion (pooled water portion), to change from downward flow to upward flow. Thereby, in the well portion, flush water generally circulates in an up-down direction, that is, a so-called "vertical circulating flow" is formed.

Further, in the conventional flush toilet described in Patent Document 1 described above, the bottom surface of the well portion (pooled water portion) that is formed in a shape of a flat surface is formed to incline downward toward the inlet of the water discharge trap, so that flush water flowing into the well portion and pooled water in the pooled water portion can be guided to the water discharge trap.

However, in the conventional flush toilet described in Patent Document 1 described above, for forming the vertical circulating flow in the pooled water portion of the well portion of the toilet bowl body, it is necessary to design a pooled water region in a relatively small size (such as a planar sectional area of the pooled water region).

However, if the size of the pooled water region of the pooled water portion is designed to be smaller than before, a surface area of a region, other than the waste receiving surface of the bowl and the pooled water portion in the well portion, increases by that size, which causes a problem that an area to which waste adheres increases.

On the other hand, if the size of the pooled water region of the pooled water portion is designed to be larger than before, it becomes difficult for the flow of flush water in the pooled water portion to gather on a center side of the pooled water portion, and hence waste is hard to collect.

As a result, a region where waste floats in the pooled water portion is also larger, and the waste tends to adhere to a wall surface in the well portion, which leads to a problem of decrease in flushing performance due to poor flushing such as unflushed waste.

An object of the present invention, which has been made to solve the above-described conventional technical problems, is to provide a flush toilet in which even if an entire pooled water region of a pooled water portion is secured large to a certain extent, adhesion of waste to an interior of a bowl (in particular, a well portion) can be prevented, and both flushing performance and waste discharge performance can be improved.

SUMMARY OF THE INVENTION

To solve the above-described problems, the present invention provides a flush toilet comprising: a bowl including a waste receiving surface having a bowl shape, a rim formed on an upper end of the waste receiving surface, and a well portion provided below the waste receiving surface so as to form a pooled water portion; a water spouting part provided on the rim, the water spouting part being configured to spout flush water toward the bowl; and a water discharge trap including an inlet connected to a lower part of the well portion so as to discharge waste in the bowl, wherein the well portion includes a bottom wall, a side wall, and a joining portion, the bottom wall being formed above and in front of the inlet of the water discharge trap, the side wall being formed to surround a periphery of the bottom wall, and the joining portion being configured to join an outer edge of the bottom wall and a bottom edge of the side wall with a surface having a curvature, and the bottom wall of the well portion includes a concave portion formed to recess downward on left and right sides with respect to a center axis in a left-right direction in a front sectional view.

According to the present invention described above, the flush water discharged from the water spouting part into the bowl flows from the waste receiving surface into the well portion.

At this time, since the bottom wall of the well portion includes the concave portion formed to recess downward on the left and right sides with respect to the center axis in the left-right direction in the front sectional view, the flush water around the pooled water portion in the well portion is collected on a concave portion side (center side in the left-right direction) of the bottom wall of the well portion.

Thereby, in the flush water in the well portion, flow of flush water converged from the bottom wall of the well portion toward the inlet of the water discharge trap can be formed.

In addition, since the left-right center of the bottom wall of the well portion has a downward recessed shape, waste that falls in a position of the pooled water portion shifted in the left-right direction can be collected in the center, and waste that falls in a center of the pooled water portion can also be smoothly guided, together with the flush water flowing into the well portion, toward the inlet of the water discharge trap.

As a result, even if an entire pooled water region of the pooled water portion is secured large to a certain extent, adhesion of waste to the interior of the bowl (in particular, the well portion) can be prevented, and decrease in flushing performance and waste discharge performance can be prevented.

In the present invention, preferably, the flush toilet further comprises a transition region where a shape of the bottom wall transits from the joining portion side toward the concave portion, the transition region being provided in a region between the joining portion and the concave portion on left and right inner sides in the front sectional view, and the transition region is formed in a flat shape or an upward protruding convex shape as being from the joining portion side toward the left and right inner sides, and then formed to transit to a concave shape of the concave portion.

According to the present invention described above, in the front sectional view of the bottom wall of the well portion, in the transition region provided in the region between the concave portion and the joining portion that joins the outer edge of the bottom wall of the well portion and the bottom edge of the side wall with the surface having the curvature, the shape of the bottom wall of the well portion is formed in the flat shape or the upward protruding convex shape as being from the joining portion side toward the left-right inner side, and then transits to the concave shape of the concave portion.

Thereby, in a state where flush water in an outer region of the concave portion in the left-right direction in the pooled water portion flows over a flat or upward protruding convex shape in the transition region into the concave portion, convex portions on left and right outer sides of the concave portion inhibit the flush water from flowing out again to the outside of the concave portion. Therefore, the flow of flush water converged toward the inlet of the water discharge trap can be formed while maintaining the state where the flush water is held in the concave portion.

Consequently, the flush water and waste flowing into the pooled water portion of the well portion can be reliably guided toward the inlet of the water discharge trap.

In the present invention, preferably, in a side sectional view, the concave portion is inclined downward as being toward an inlet side of the water discharge trap on a rear side of the concave portion.

According to the present invention described above, in the side sectional view of the well portion, since the concave portion is inclined downward as being toward the inlet side of the water discharge trap on the rear side of the concave portion, the whole concave portion can be formed in a shape pointing toward the inlet of the water discharge trap on the rear side.

Therefore, when the flush water and waste flowing into the pooled water portion of the well portion flow into the concave portion, these flush water and waste do not stay in the pooled water portion and can be smoothly directed to the inlet of the water discharge trap.

Therefore, both flushing performance (flushing power) and waste discharge performance (discharge power) in the flush toilet can be improved.

In the present invention, preferably, in a planar view, the concave portion is formed in a fan shape in such a manner that a width of the concave portion in the left-right direction increases toward the inlet side of the water discharge trap on a rear side of the concave portion.

According to the present invention described above, in the planar view of the concave portion of the well portion, the concave portion is formed in the fan shape in such a manner that the width of the concave portion in the left-right direction increases toward the inlet side of the water discharge trap on the rear side. Therefore, the flush water and waste flowing into the pooled water portion of the well portion flows into the concave portion, and then the waste can be guided in a wide range of the inlet of the water discharge trap on the rear side of this concave portion.

In addition, when flush water and waste flowing rearward out of the concave portion flow into the inlet of the water discharge trap, a strong pushing force can be generated over an entire region of the inlet of the water discharge trap, so that the waste guided to the entire region of the inlet of the water discharge trap can be inhibited from being clogged in a flow channel of the water discharge trap.

Therefore, both the flushing performance (flushing power) and the waste discharge performance (discharge power) in the flush toilet can be more effectively improved.

In the present invention, preferably, in a side sectional view, the concave portion has a bottom surface protruding downward in a front-rear direction.

According to the present invention described above, since the bottom surface of the concave portion of the well portion protrudes downward in the front-rear direction in the side sectional view, a concave surface extending in the front-rear direction can be formed.

Thereby, the flush water and waste in the concave portion flow, to the inlet side of the water discharge trap, along the concave surface extending in the front-rear direction and are accordingly guided to the inlet of the water discharge trap with a strong flux, so that the flush water and waste can flow reliably into the water discharge trap.

Therefore, both the flushing performance (flushing power) and the waste discharge performance (discharge power) in the flush toilet can be further effectively improved.

In the present invention, preferably, in the concave portion, in a front sectional view or side sectional view, a concave amount in a vertical direction from a top of a portion formed in a convex shape in the transition region to a lowermost bottom surface of the concave portion is set to increase toward the inlet side of the water discharge trap on a rear side.

According to the present invention described above, in the front sectional view or side sectional view of the concave portion of the well portion, the concave amount in the vertical direction from the top of the portion formed in the convex shape in the transition region to the lowermost bottom of the concave portion is set to increase toward the inlet side of the water discharge trap on the rear side, so that the flush water and waste in the concave portion can be inhibited from flowing to the outside of the concave portion over the flat or upward protruding convex portion in the transition region.

Thereby, while maintaining the state where the flush water is held in the concave portion, flow of flush water converged toward the inlet of the water discharge trap can be formed.

Therefore, the flush water and waste flowing into the pooled water portion of the well portion can be reliably guided toward the inlet of the water discharge trap by the flow of the converged flush water formed in the concave portion.

In the present invention, preferably, in a region between the joining portion and the concave portion in front of the concave portion, a guiding portion formed in a flat shape or an upward protruding convex shape is provided so as to inhibit the flush water flowing into the region from excessively flowing into the concave portion.

According to the present invention described above, the flush water discharged from the water spouting part into the bowl flows from the waste receiving surface into the well portion.

At this time, part of the flush water flowing into the region between the joining portion and the concave portion in front of the concave portion of the well portion collides with the guiding portion formed in the flat shape or the upward protruding convex shape, so that flow guided in a circumferential direction of the well portion and circulating without flowing into the concave portion can be formed.

Therefore, the flush water flowing into the pooled water portion in the well portion is inhibited from excessively flowing into the concave portion, so that flow that circulates in the well portion can be secured, and flow that pushes from the concave portion into the inlet of the water discharge trap can be secured.

Consequently, since both the flushing performance (flushing power) and the waste discharge performance (discharge power) in the well portion of the bowl in the flush toilet can be achieved, overall flushing performance of the flush toilet can be improved.

In the present invention, preferably, in a side sectional view, the concave portion has a bottom surface including a rear end connected to the inlet of the water discharge trap, a tangent line extending from the rear end along the bottom surface in a front-rear direction, and a tangential extension of the tangent line extended rearward from the rear end of the bottom surface, in the side sectional view, the water discharge trap forms a trap pipeline extending rearward and downward from the inlet to a lowermost end and then extending rearward and upward from the lowermost end, and in the side sectional view, the tangential extension is located in the trap pipeline to pass a height position below an upper surface in the trap pipeline from the inlet of the water discharge trap to the lowermost end.

According to the present invention described above, in the side sectional view of the concave portion of the well portion and the water discharge trap, the tangential extension, of the tangent line further extended rearward, extending from the rear end of the bottom surface of the concave portion along the bottom surface in the front-rear direction can be positioned in the trap pipeline to pass the height position below the upper surface in the trap pipeline from the inlet of the water discharge trap to the lowermost end.

Thereby, when the flush water and waste flowing into the pooled water portion of the well portion flow into the concave portion, these flush water and waste do not stay in the pooled water portion and can be more smoothly directed from the inlet of the water discharge trap to an interior of the water discharge trap.

Therefore, both the flushing performance (flushing power) and the waste discharge performance (discharge power) in the flush toilet can be effectively improved.

In the present invention, preferably, a front end of the inlet of the water discharge trap is provided at a position lower than a rear end of the inlet of the water discharge trap.

According to the present invention described above, the flush water discharged from the water spouting part into the bowl flows from the waste receiving surface into the well portion.

In this case, the flush water flowing from an upper and front waste receiving surface of the well portion to a front region in the well portion is guided from the front region in the well portion along the bottom surface of the bottom wall of the well portion to a front end side of the inlet of the water discharge trap that is joined to the rear end at the left-right center of the well portion.

At this time, since the front end of the inlet of the water discharge trap is provided at the position lower than the rear end of the inlet of the water discharge trap, a structure having a height difference between a low front side and a high rear side in the inlet of the water discharge trap can be obtained.

Thus, when the flush water including the waste flowing from the front region in the well portion and near the front end of the inlet of the water discharge trap flows toward the water discharge trap on the rear side, the flush water can smoothly pass at the rear end of the inlet of the water discharge trap without stagnating and can smoothly flow into the water discharge trap.

Therefore, since the waste in the bowl can be smoothly guided to the water discharge trap, the waste discharge performance (discharge power) in the flush toilet can be improved.

In the present invention, preferably, the well portion includes a bottom wall formed above and in front of the inlet of the water discharge trap, a rear wall provided on a rear side of the inlet of the water discharge trap, rear side walls provided so as to extend forward from left and right ends of the rear wall to left and right outer sides, and front side walls provided forward from left and right front ends of the rear side walls to narrow on left and right inner sides, the front side walls having front ends joined to each other, in the rear side walls, left and right wall surfaces in a planar view are formed to be located on an inner side of the well portion as being from top to bottom, and a protrusion protruding forward is provided over a rear end of the inlet of the water discharge trap in a lower region of the rear wall.

According to the present invention described above, the flush water discharged from the water spouting part into the bowl flows from the waste receiving surface into the well portion.

At this time, the flush water flowing from the upper and front waste receiving surface of the well portion along the front side wall in the well portion to the rear side wall is guided to a lower part of the well portion along the left and right wall surfaces of the rear side walls located on the inner side of the well portion as being from top to bottom in a planar view of the rear side wall.

Then, the flush water guided to the lower part of the well portion further collides from above with the protrusion provided above the rear end of the inlet of the water discharge trap in the lower region of the rear wall of the well portion and splashes upward, forward or the like, and the flow of flush water is accordingly changed to an overall upward flow.

Thereby, the flow of flush water forms a flow that circulates in a vertical direction (hereinafter referred to as "vertical circulating flow"), and the waste in the well portion is stirred together with the flush water flowing into the well portion and the pooled water in the pooled water portion, and then discharged from the inlet of the water discharge trap into the water discharge trap.

Therefore, the flush water and pooled water including the waste in the well portion can be easily stirred, and hence the waste discharge performance of the flush toilet can be improved.

In the present invention, preferably, the protrusion is provided in an entire region in a left-right width direction in a lower end of the rear wall of the well portion and a rear end of the inlet of the water discharge trap, and a front end of the protrusion in a planar view is formed in a rearward convex curved shape.

According to the present invention described above, the flush water spouted from the water spouting part into the bowl flows from the waste receiving surface into the well portion.

In the flush water flowing into this well portion, the flush water flowing from the waste receiving surface in front of the well portion along the front side wall in the well portion to the rear side wall collides with the wall surface of the rear side wall, and is then guided along the wall surface of the rear side wall toward the lower and rear part of the well portion and flows into the lower end of the rear wall of the well portion and near the rear end of the inlet of the water discharge trap.

Then, in the flush water flowing into the lower end of the rear wall of the well portion and near the rear end of the inlet of the water discharge trap, the flush water having a vector of flow that is not directed rearward but is directed downward flows from the inlet of the water discharge trap into the water discharge trap in a state of maintaining the flow vector.

On the other hand, in the flush water flowing into the lower end of the rear wall of the well portion and near the rear end of the inlet of the water discharge trap, the flush water having a vector of rearward flow collides from above with the protrusion provided above the rear end of the inlet of the water discharge trap in the lower region of the rear wall of the well portion and splashes upward, forward or the like. Thereby, the flow of flush water is changed to an overall upward and forward flow, and a vertical circulating flow is formed in the well portion.

In addition, the flush water of the vertical circulating flow in this well portion forms flow that circulates around once and then from the inlet of the water discharge trap toward the water discharge trap, so that the waste in the well portion can be stirred by the vertical circulating and then pushed into the water discharge trap.

As a result, the waste discharge performance of the flush toilet can be further effectively improved.

In the present invention, preferably, in a side sectional view, the water discharge trap includes a protrusion provided over a rear end of the inlet of the water discharge trap, the protrusion protruding forward, and a trap pipeline extending rearward and downward from the protrusion to a lowermost end and then extending rearward and upward from the lowermost end, and in the trap pipeline from the protrusion to the lowermost end of the water discharge trap, an upper surface shape in the side sectional view is formed in a substantially flat shape.

According to the present invention described above, the upper surface shape in the trap pipeline rearward and downward from the protrusion provided above the rear end of the inlet in the water discharge trap to the lowermost end is the substantially flat shape. Therefore, when the flush water flowing from the front region in the well portion along the bottom surface of the bottom wall to the rear side flows from the inlet of the water discharge trap into the trap pipeline, the flush water is smoothly guided to a downstream side along an interior of the trap pipeline from the protrusion above the rear end of the inlet of the water discharge trap to the lowermost end of the trap pipeline.

At this time, the flush water flowing through the trap pipeline rearward and downward from the protrusion to the lowermost end smoothly flows along the upper surface with the substantially flat shape in the side sectional view of the trap pipeline, so that pressure loss due to collision of the flush water with the upper surface in the trap pipeline rearward and downward from the protrusion to the lowermost end can be prevented.

As a result, since the waste in the bowl can be smoothly discharged from the water discharge trap, the waste discharge performance (discharge power) in the flush toilet can be improved.

In the present invention, preferably, the bowl further includes a joining portion that joins a top edge of the side wall of the well portion and a bottom edge of the waste receiving surface with a surface having a curvature, and a vertical width of the joining portion in a side sectional view is set to decrease from a rear side toward a front side.

According to the present invention described above, the vertical width, in the vertical direction in the side sectional view, of the joining portion that joins the top edge of the side wall of the well portion and the bottom edge of the waste receiving surface with the surface having the curvature is set to decrease from the rear side toward the front side, so that the well portion and the waste receiving surface can be brought closer to each other in the vertical direction as being from the rear side toward the front side.

Therefore, in particular, for the waste in the front region on the waste receiving surface, the flush water discharged from the water spouting part onto the waste receiving surface can be efficiently conveyed to the front region in the well portion, and hence both the flushing performance (flushing power) and the waste discharge performance (discharge power) in the flush toilet can be improved.

The flush toilet of the present invention is capable of preventing adhesion of waste in a bowl (in particular, a well portion) even if an entire pooled water region of a pooled water portion is secured large to a certain extent, and is thus capable of improving both flushing performance and waste discharge performance.

DETAILED DESCRIPTION OF THE PREFERRED EMBODIMENTS

Hereinafter, description will be made as to a flush toilet according to one embodiment of the present invention with reference to FIGS. 1 to 10.

Figure 1:
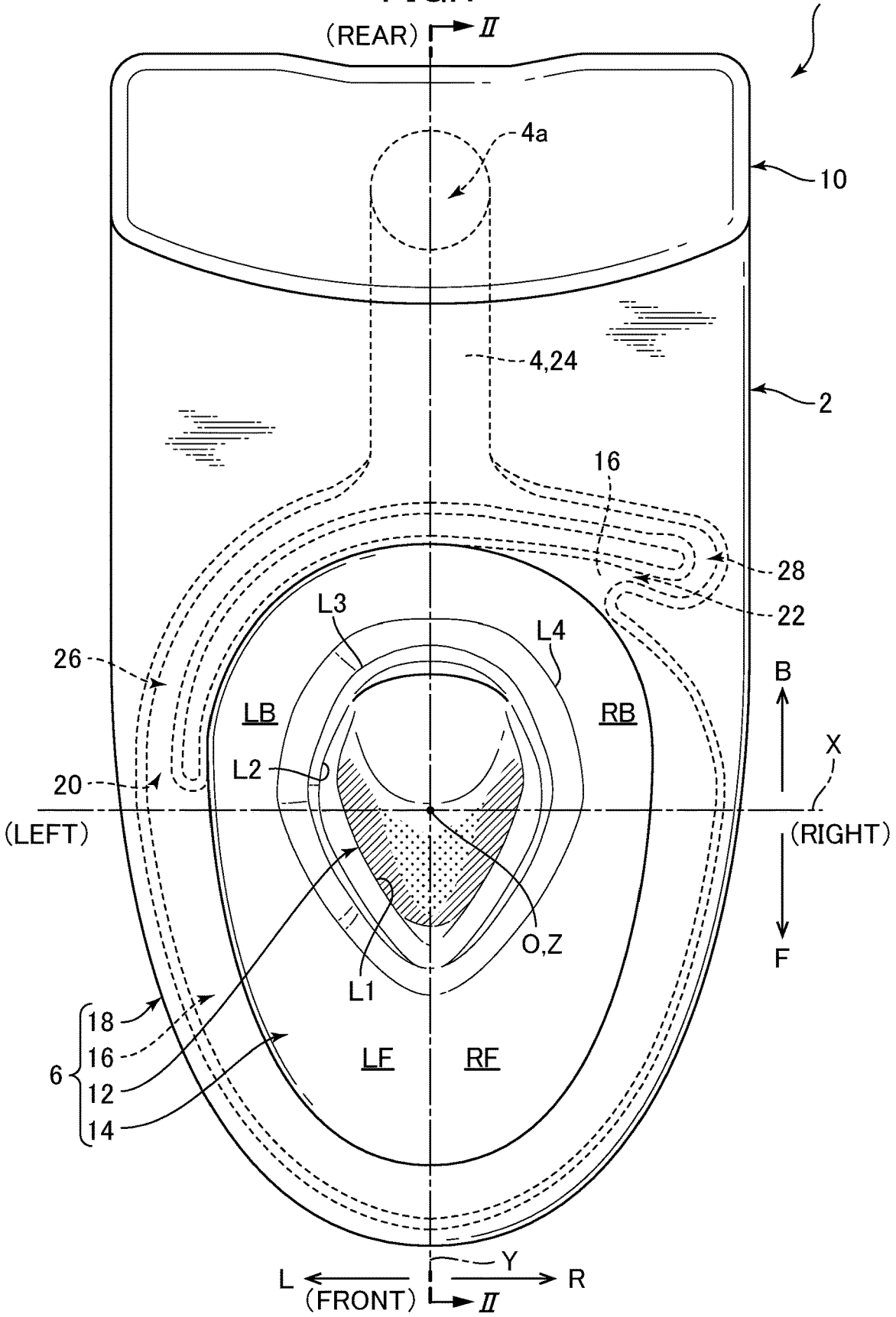
FIG. 1 is a schematic plan view of a flush toilet according to one embodiment of the present invention.
Figure 2:
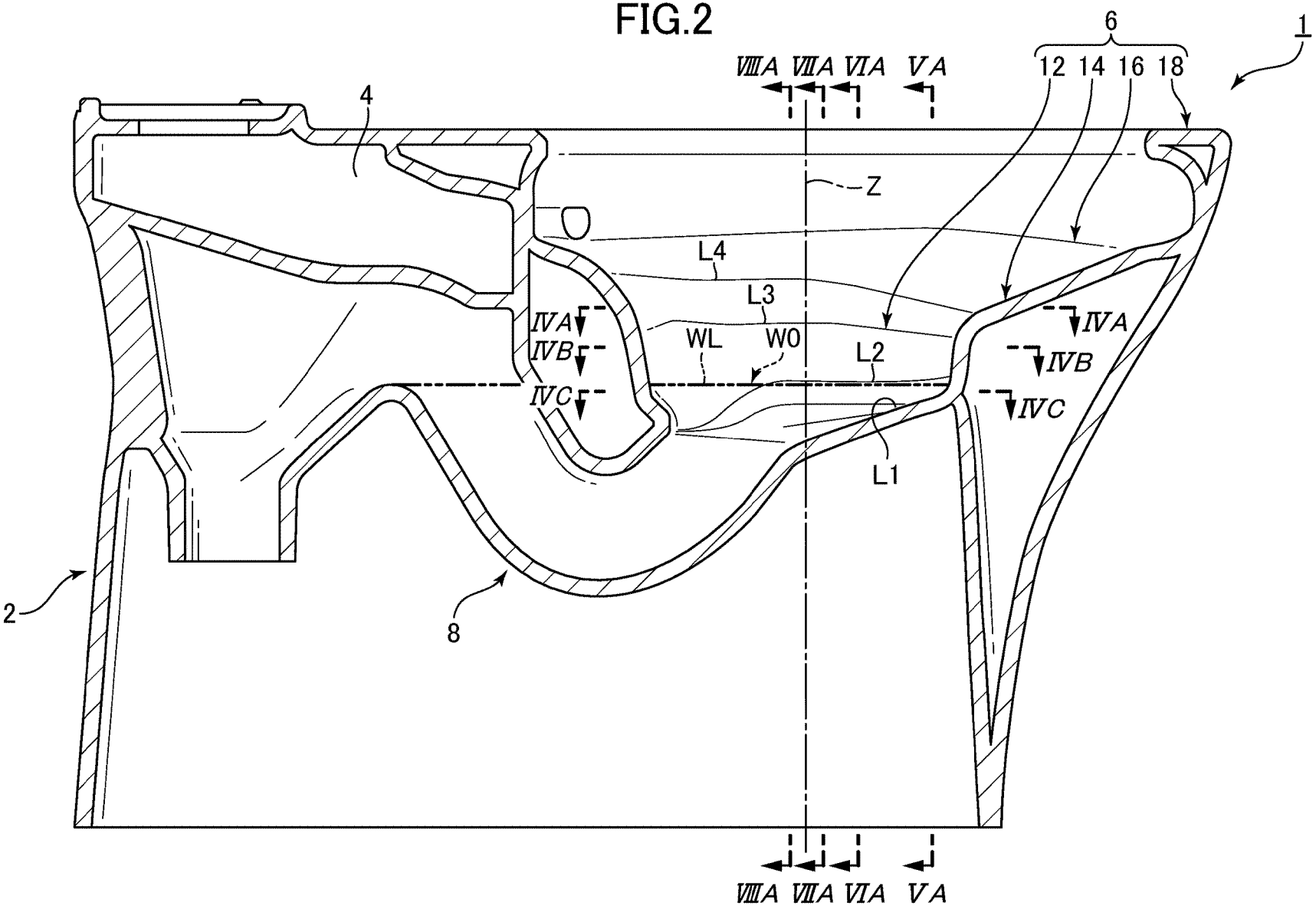
FIG. 2 is a side sectional view along the II-II line of FIG. 1.

As shown in FIGS. 1 and 2, a flush toilet 1 according to one embodiment of the present invention includes a pottery toilet main body 2.

The toilet main body 2 includes a water conduit 4, a bowl-shaped bowl 6, and a water discharge trap 8 from an upstream side toward a downstream side.

Thereby, the flush toilet 1 according to one embodiment of the present invention is a so-called "siphon-type flush toilet" in which waste in the bowl 6 is suctioned and discharged to outside through the water discharge trap 8 at once by use of siphon action.

In addition, the flush toilet 1 according to one embodiment of the present invention is not limited to a form of the siphon-type flush toilet and is also applicable to a form of a so-called "wash-away type flush toilet" that washes off waste by running water action due to drop of water in the bowl.

Also, in the flush toilet 1 of the present embodiment shown in FIGS. 1 and 2, a toilet seat (not shown), a toilet lid (not shown) and others are provided on an upper surface of the toilet main body 2, but this structure is similar to a conventional flush toilet structure, and hence specific description will not be made.

Furthermore, on a rear side of the toilet seat (not shown) and the toilet lid (not shown) on the upper surface of the toilet main body 2, a sanitary washing part (not shown) for washing a private part of a human body of a user, a functional part (not shown) such as a water supply system functional part involved in a water supply function to the toilet main body 2 and others may be provided. Since this structure is also similar to the structure of the conventional flush toilet, specific description will not be made.

Next, as shown in FIG. 1, the flush toilet 1 according to one embodiment of the present invention includes a gravity water supply type storage tank 10 that is a flush water supply source that stores flush water for use in toilet flushing and supplies water to the toilet main body 2.

Here, in the present embodiment, the flush water supply source that supplies flush water to the toilet main body 2 is not limited to a form of a tank type such as the above-described gravity water supply type storage tank 10 and is also applicable to another form. Specifically, the flush water supply source that supplies flush water to the toilet main body 2 may be a form of tap water direct pressure type or flush valve type directly using a water supply pressure of tap water, or a form of supplying flush water by use of pressure compensation of a pump.

Next, in the flush toilet 1 according to one embodiment of the present invention shown in FIG. 1, in a planar view of the bowl 6 of the toilet main body 2, sign "X" indicates a center axis extending horizontally in a left-right direction to divide a well portion 12 provided at a center of the bowl 6 in the left-right direction into two equal parts in a front-rear direction.

Further, in the planar view of the bowl 6 of the toilet main body 2 shown in FIG. 1, sign "Y" indicates a center axis extending horizontally in the front-rear direction to divide the bowl 6 into two equal parts in the left-right direction.

Furthermore, in the planar view of the bowl 6 of the toilet main body 2 shown in FIG. 1, an intersection point of the respective center axes X and Y with each other is a center O of the bowl 6 in the planar view, and sign "Z" indicates a center axis extending in a vertical direction through the center O in FIGS. 1 and 2.

Further, as shown in FIG. 1, "front", "rear", "left" and "right" indicate the front-rear and left-right directions of the flush toilet 1.

Furthermore, as shown in FIGS. 1 and 2, for a region in the bowl 6 in the flush toilet 1 of the present embodiment, a region in the bowl 6 in front of the center axis X is defined as "a front region F of the bowl 6". Further, in the front region F of the bowl 6, a left region L and a right region R with respect to the center axis Y of the bowl 6 in the horizontal front-rear direction are defined as "a left front region LF of the bowl 6" and "a right front region RF of the bowl 6", respectively.

Similarly, for the region in the bowl 6, a region on a rear side of the center axis X is defined as "a rear region B of the bowl 6". Further, in the rear region B of the bowl 6, the left region L and the right region R with respect to the center axis Y in the horizontal front-rear direction of the bowl 6 are defined as "a left rear region LB of the bowl 6" and "a right rear region RB of the bowl 6", respectively.

Next, as shown in FIG. 1, the water conduit 4 located on an upstream side of the toilet main body 2 is formed on a rear side of the bowl 6 and guides flush water supplied from the storage tank 10 to the bowl 6.

Further; as shown in FIGS. 1 and 2, the bowl 6 located on a downstream side of the water conduit 4 of the toilet main body 2 includes, from bottom toward top, the well portion 12, a waste receiving surface 14, a shelf 16, and a rim 18, which will be described later in detail.

Furthermore, a first rim spouting port 20 is provided on a front side of the rim 18 in the left rear region LB of the bowl 6, and a second rim spouting port 22 is provided on a rear side of the rim 18 in the right rear region RB of the bowl 6.

Next, as shown in FIGS. 1 and 2, the water conduit 4 includes a common conduit 24, a first rim conduit 26, and a second rim conduit 28.

First, the common conduit 24 is formed inside the toilet main body 2 on the rear side of the bowl 6 so as to extend forward from a rear inlet 4*a* connected to the storage tank 10 to the vicinity of a back side of the bowl 6.

The first rim conduit 26 is formed inside the rim 18 in the left rear region LB of the bowl 6 so as to branch from the common conduit 24 to a left side of the bowl 6 in the vicinity of the back side of the bowl 6, and then extend to the first rim spouting port 20 on the front side while bypassing an outer circumferential surface of the bowl 6.

Thereby, the flush water supplied from the common conduit 24 to the first rim conduit 26 is spouted forward as first rim spout water from the first rim spouting port 20 toward the shelf 16 on a front side of the first rim spouting port, and then forms a circulating flow circulating from the left front region LF through the right front region RF to the right rear region RB in the bowl 6.

Further, the second rim conduit 28 is formed inside the rim 18 on a rear side of the right rear region RB of the bowl 6 so as to branch from the common conduit 24 to a right side of the bowl 6 in the vicinity of the back side of the bowl 6, then bend (U-turn) toward the second rim spouting port 22 on a left side near a right part of the toilet main body 2, and extend to the second rim spouting port 22.

Thereby, the flush water supplied from the common conduit 24 to the second rim conduit 28 is spouted rearward as second rim spout water from the second rim spouting port 22 toward the shelf 16 on a rear side of the second rim spouting port, then circulates from the right rear region RB through the left rear region LB to a left front region LF region in the bowl 6, and then flows from the left front region LF region into a front region in the well portion 12.

Further, part of the second rim spout water spouted from the second rim spouting port 22 flows from a region of the waste receiving surface 14 behind the well portion 12 of the bowl 6 into a rear region in the well portion 12.

In the present embodiment, a form in which the shelf 16 of the bowl 6 is provided between an outer edge of the waste receiving surface 14 and a lower end of the rim 18 will be described, but the shelf 16 does not necessarily have to be provided. The shelf 16 may not be provided, and the first rim spout water and the second rim spout water spouted from the first rim spouting port 20 and the second rim spouting port 22, respectively, may be directly spouted into a top edge portion of the waste receiving surface 14 without passing through the shelf 16.

Next, details of the well portion 12 of the bowl 6 and a peripheral part of the well portion will be described with reference to FIGS. 1 to 8B.

Figure 3A:
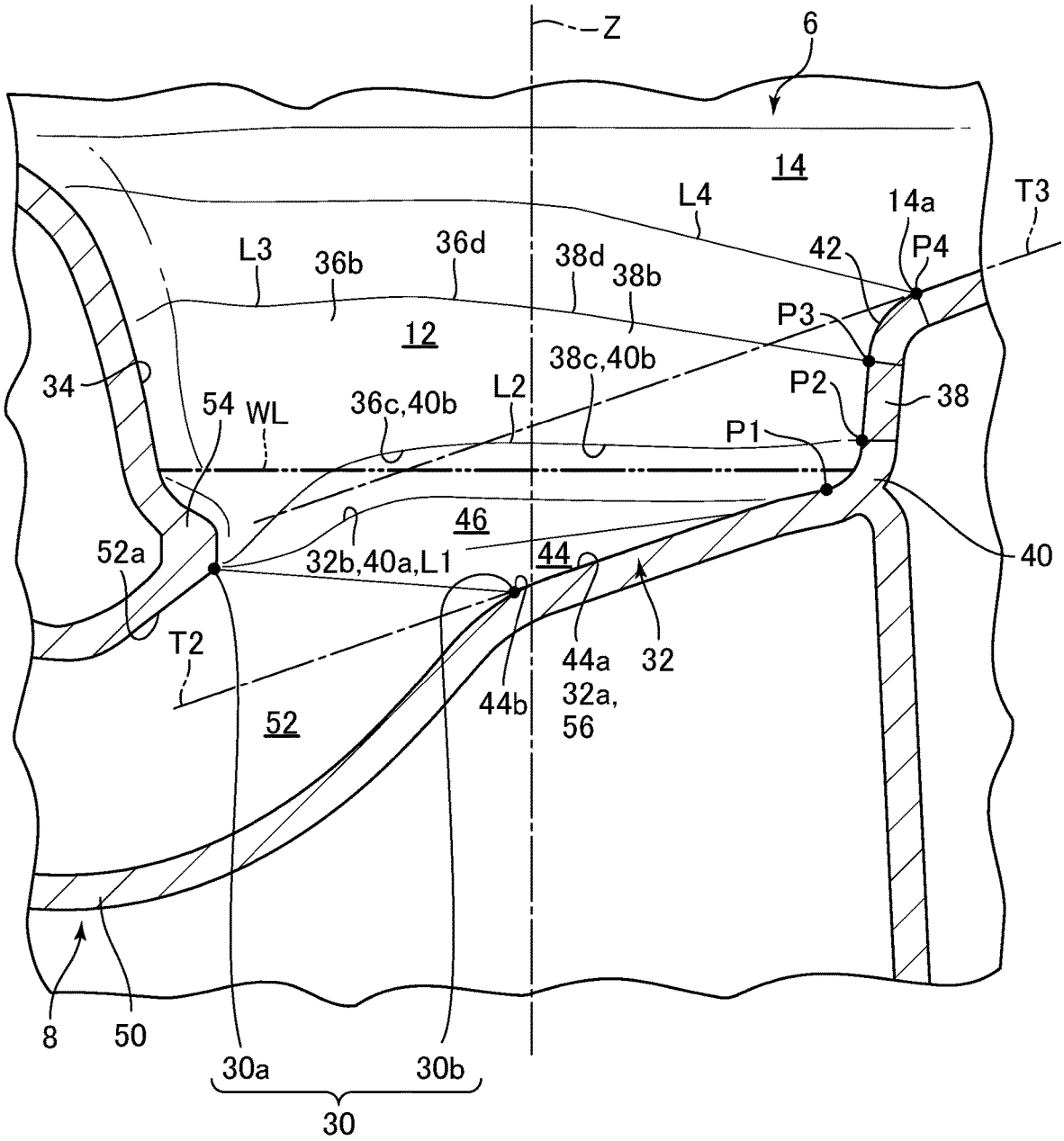
FIG. 3A is an enlarged side sectional view of an enlarged part of a well portion of a toilet main body in the side sectional view of the flush toilet according to one embodiment of the present invention shown in FIG. 2.

First, as shown in FIGS. 2 and 3A, the well portion 12 of the bowl 6 is provided below the waste receiving surface 14, and a pooled water portion W0 is formed by stored pooled water.

Here, in FIGS. 2 and 3A, a water level (sealed water level) on a pooled water surface of the pooled water portion W0 of the well portion 12 of the bowl 6 in a standby state (sealed water state) before toilet flushing is performed is denoted with sign "WL".

Next, as shown in FIGS. 3A to 8B, the well portion 12 includes a bottom wall 32 provided above and in front of an inlet 30 of the water discharge trap 8 to form a bottom surface 32*a* of the well portion 12.

The well portion 12 also includes a rear wall 34 (a left rear wall 34*a* and a right rear wall 34*b*) provided on a rear side of the inlet 30 of the water discharge trap 8.

Furthermore, the well portion 12 includes a side wall 36 (a rear side wall 36, a rear left wall 36*a*, and a rear right wall 36*b*) provided so as to extend forward to left and right outer sides from left and right ends of the rear wall 34 (a left end portion of the left rear wall 34*a* and a right end portion of the right rear wall 34*b*).

The well portion 12 includes side walls 38 (a front side wall 38, a front left wall 38*a*, a front right wall 38*b*) provided forward from left and right front ends of the rear side walls 36 (respective front ends of the rear left wall 36*a* and the rear right wall 36*b*) to narrow inward in the left-right direction, the side walls having the front ends joined to each other.

Next, as shown in FIGS. 3A, 3B, 5B, 6B, 7B and 8B, the well portion 12 further includes a lower joining portion 40 that joins an outer edge 32*b* of the bottom surface 32*a* of the bottom wall 32 and a bottom edge 36*c*, 38*c* of the side wall 36, 38 with a surface (curved surface C1) having a curvature.

Figure 3B:
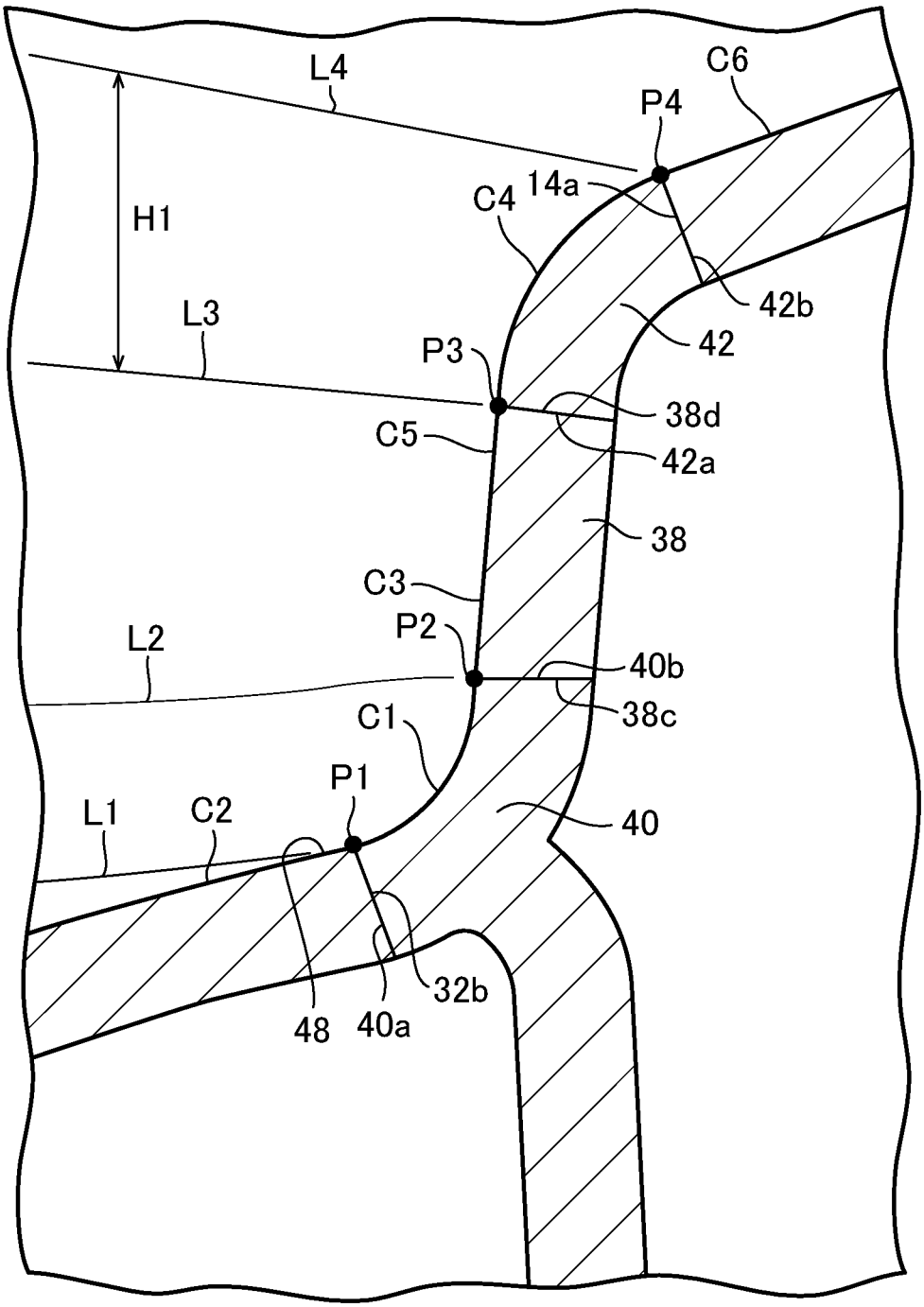
FIG. 3B is an enlarged side sectional view of an enlarged front part of the well portion of the toilet main body of the flush toilet according to one embodiment of the present invention shown in FIG. 3A.

Additionally, in a side sectional view of FIGS. 3A and 3B, and a front sectional view of FIGS. 5B, 6B, 7B and 8B, a curvature of the curved surface C1 of a section between a bottom edge 40*a* and a top edge 40*b* of the lower joining portion 40 is set to be larger than a curvature of a tangent plane C2 including the bottom surface 32*a* at a lower joining point P1 that joins the bottom edge 40*a* of the lower joining portion 40 (the bottom edge 40*a* of the curved surface C1) and the outer edge 32*b* of the bottom surface 32*a* of the bottom wall 32.

Similarly, in the side sectional view of FIGS. 3A and 3B and the front sectional view of FIGS. 5B, 6B, 7B and 8B, the curvature of the curved surface C1 of the lower joining portion 40 is set to be larger than a curvature of a tangent plane C3 including a wall surface of the side wall 36, 38 at an upper joining point P2 that joins the top edge 40*b* of the lower joining portion 40 (the top edge 40*b* of the curved surface C1) and the bottom edge 36*c*, 38*c* of the side wall 36, 38.

Next, as shown in FIGS. 3A, 3B, 5B, 6B, 7B and 8B, the well portion 12 further includes an upper joining portion 42 that joins a top edge 36*d*, 38*d* of the side wall 36, 38 and a bottom edge 14*a* of the waste receiving surface 14 with a surface having a curvature (curved surface C4).

In the side sectional view of FIGS. 3A and 3B and the front sectional view of FIGS. 5B, 6B, 7B and 8B, a curvature of the curved surface C4 in a section between a bottom edge 42*a* and a top edge 42*b* of the upper joining portion 42 is set to be larger than a curvature of a tangent plane C5 including a wall surface of the side wall 36, 38 at a lower joining point P3 that joins the bottom edge 42*a* of the upper joining portion 42 (the bottom edge 42*a* of the curved surface C4) and the top edge 36*d*, 38*d* of the side wall 36, 38.

Similarly, in the side sectional view of FIGS. 3A and 3B, and the front sectional view of FIGS. 5B, 6B, 7B and 8B, the curvature of the curved surface C4 of the upper joining portion 42 is set to be larger than a curvature of a tangent plane C6 including a wall surface of the waste receiving surface 14 at an upper joining point P4 that joins the top edge 42*b* of the upper joining portion 42 (the top edge 42*b* of the curved surface C4) and the bottom edge 14*a* of the waste receiving surface 14.

Here, in the flush toilet 1 of the present embodiment shown in FIGS. 1 to 4C, a boundary line between the bottom wall 32 of the well portion 12 and the lower joining portion 40, corresponding to the outer edge 32*b* of the bottom wall 32 of the well portion 12 and the bottom edge 40*a* of the lower joining portion 40, is denoted with sign "L1".

Also, a boundary line between the lower joining portion 40 of the well portion 12 and the side wall 36, 38, corresponding to the top edge 40*b* of the lower joining portion 40 of the well portion 12 and the bottom edge 36*c*, 38*c* of the side wall 36, 38, is denoted with sign "L2".

Further, a boundary line between the side wall 36, 38 of the well portion 12 and the upper joining portion 42, corresponding to the top edge 36*d*, 38*d* of the side wall 36, 38 of the well portion 12 and the bottom edge 42*a* of the upper joining portion 42, is denoted with sign "L3".

Additionally, a boundary line between the upper joining portion 42 of the well portion 12 and the waste receiving surface 14, corresponding to the top edge 42*b* of the upper joining portion 42 of the well portion 12 and the bottom edge 14*a* of the waste receiving surface 14, is denoted with sign "L4".

Furthermore, as shown in FIGS. 3A and 3B, a distance in a vertical direction between the well portion 12 and the waste receiving surface 14 (a distance in the vertical direction between the boundary line L3 and the boundary line L4 shown in FIG. 3A) corresponds to a width H1 (vertical width H1) in the vertical direction from the bottom edge 42*a* to the top edge 42*b* in the side sectional view of the upper joining portion 42, and the width H1 in the vertical direction is set to decrease from a rear side toward a front side of the well portion 12.

Thereby, the well portion 12 and the waste receiving surface 14 can be brought closer to each other in the vertical direction from the rear side toward the front side.

Figure 6A:
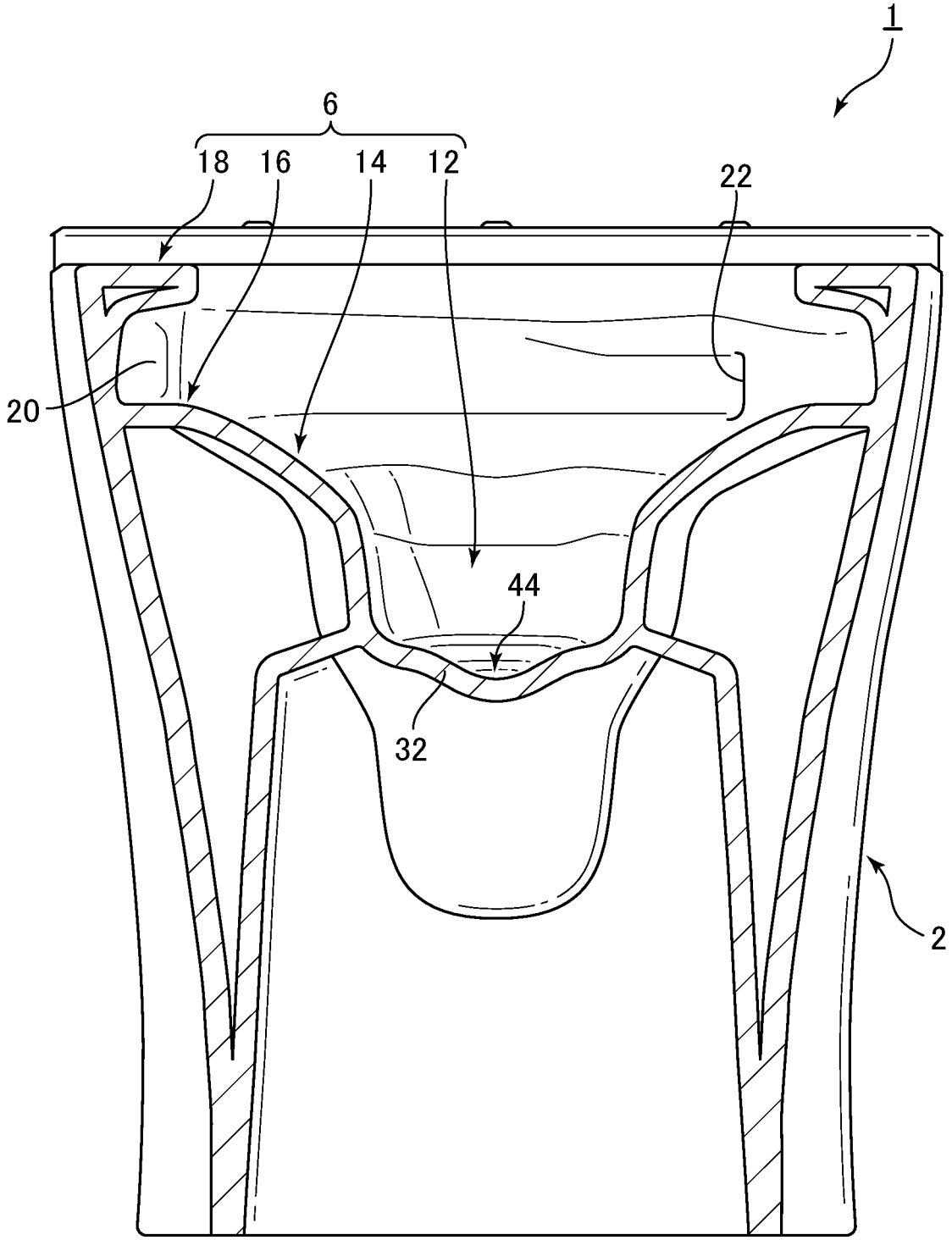
FIG. 6A is a cross-sectional view along the VIA-VIA line of FIG. 2.
Figure 6B:
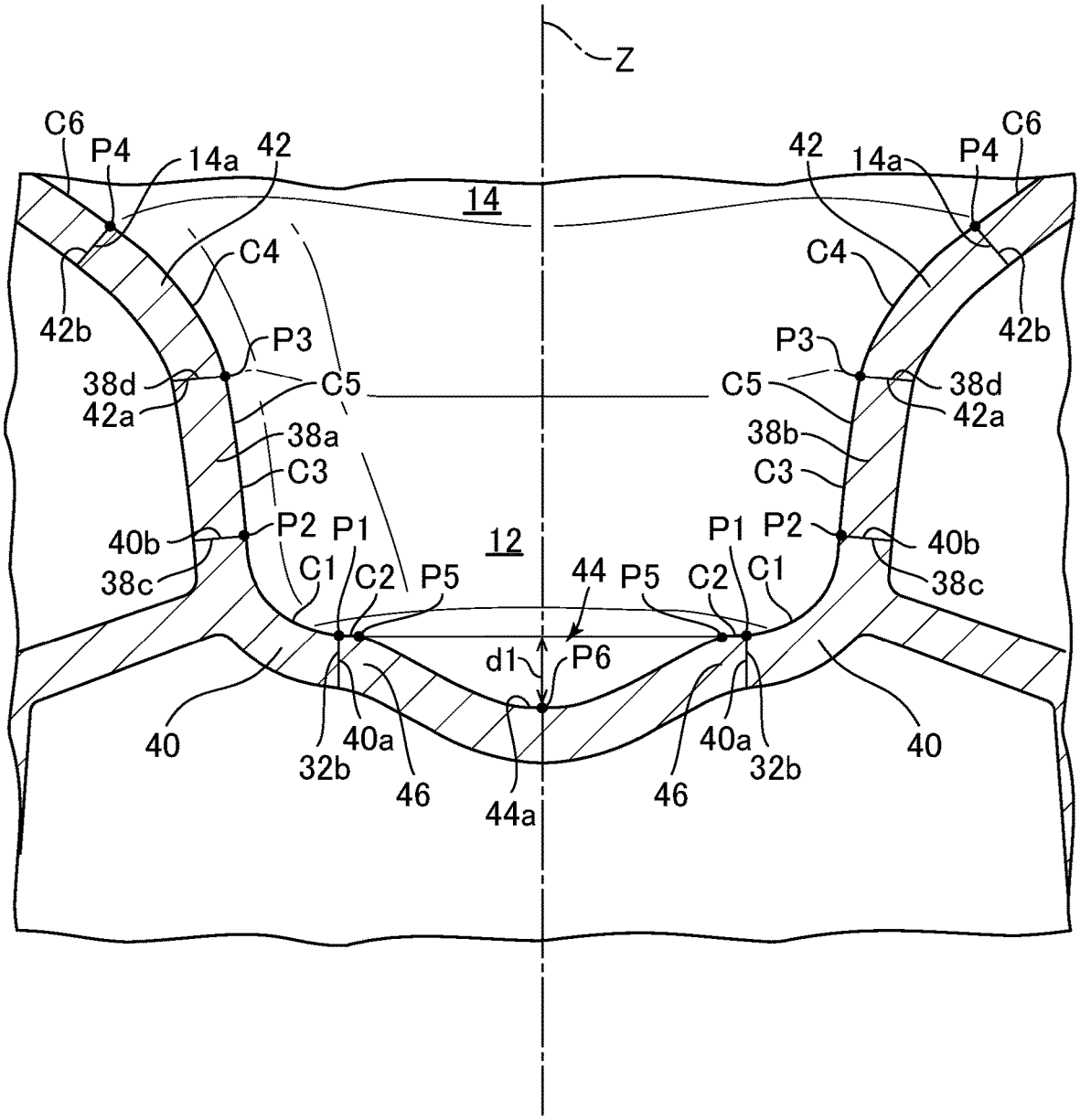
FIG. 6B is a cross-sectional view of an enlarged part of a well portion of a bowl in a toilet main body of a flush toilet according to one embodiment of the present invention shown in FIG. 6A.
Figure 7A:
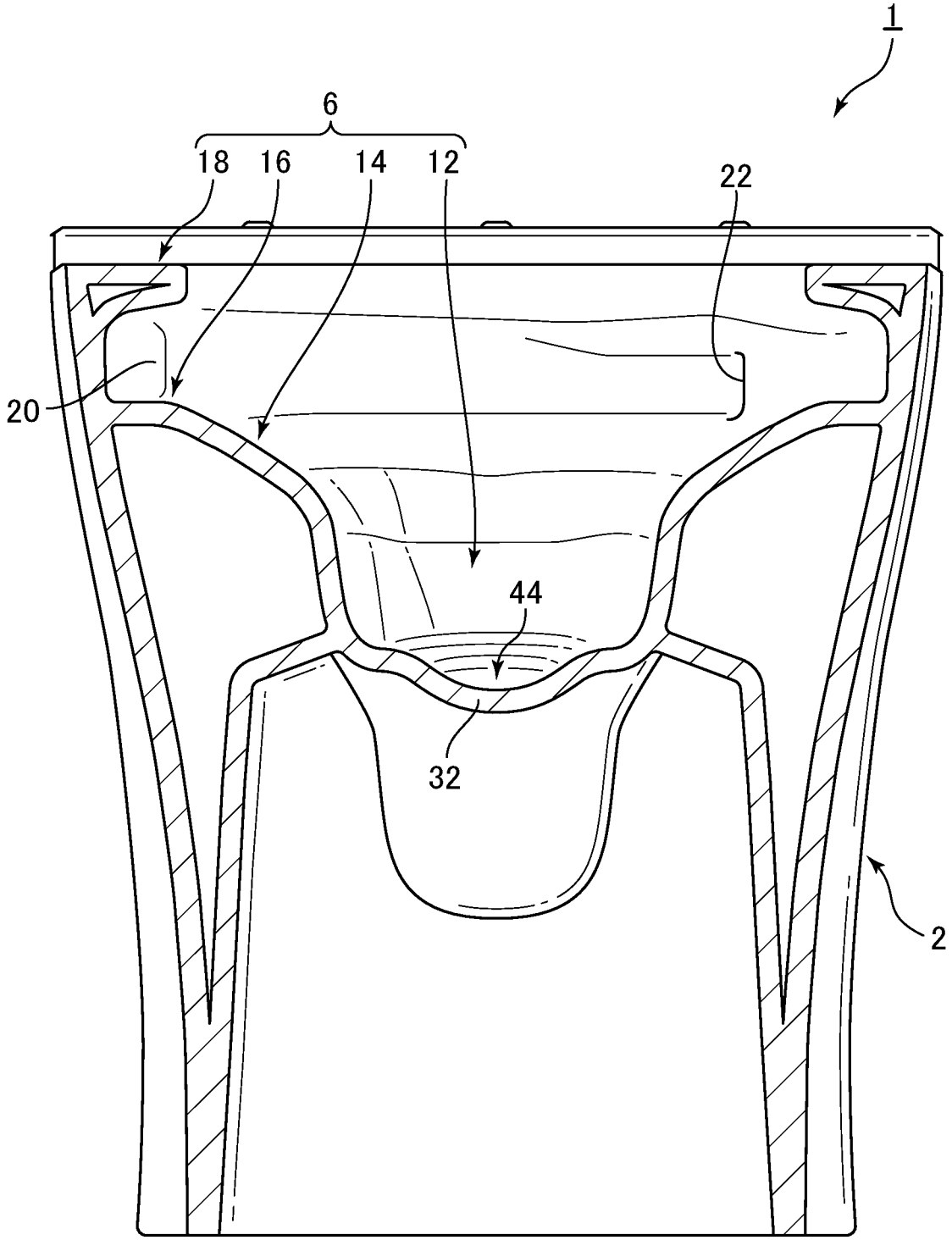
FIG. 7A is a cross-sectional view along the VIIA-VIIA line of FIG. 2.
Figure 7B:
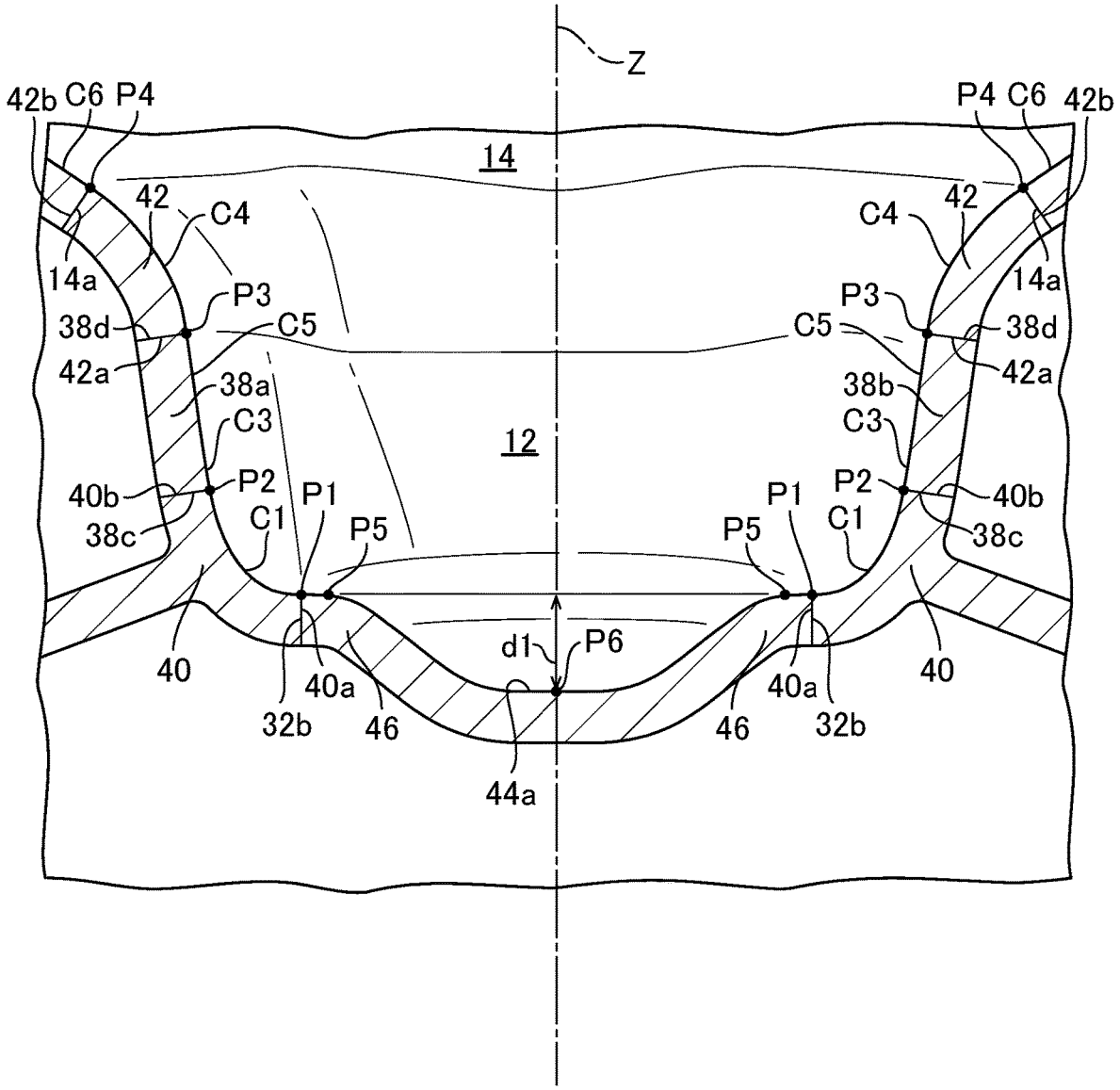
FIG. 7B is a cross-sectional view of an enlarged part of a well portion of a bowl in a toilet main body of a flush toilet according to one embodiment of the present invention shown in FIG. 7A.
Figure 8A:
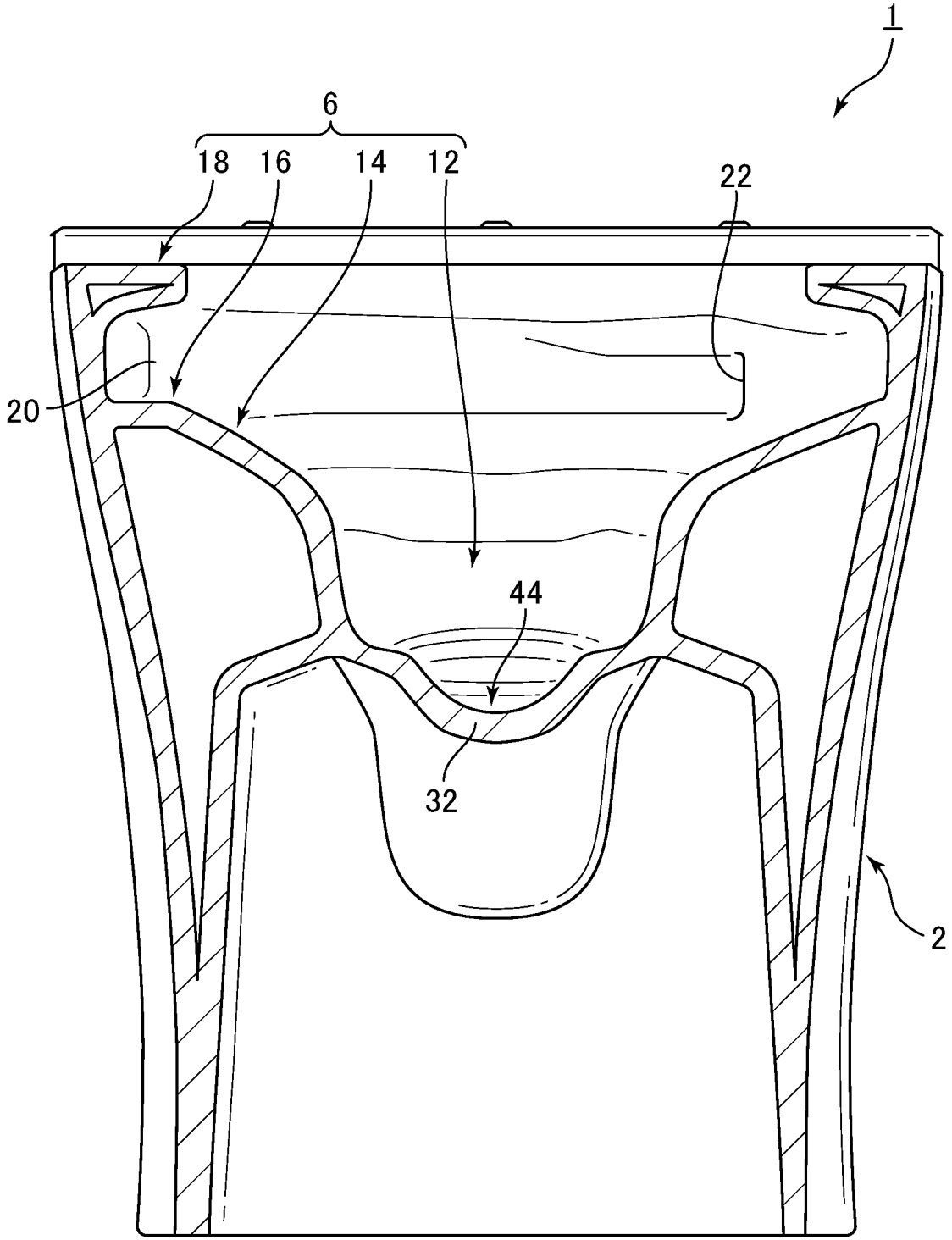
FIG. 8A is a cross-sectional view along the VIIIA-VIIIA line of FIG. 2.
Figure 8B:
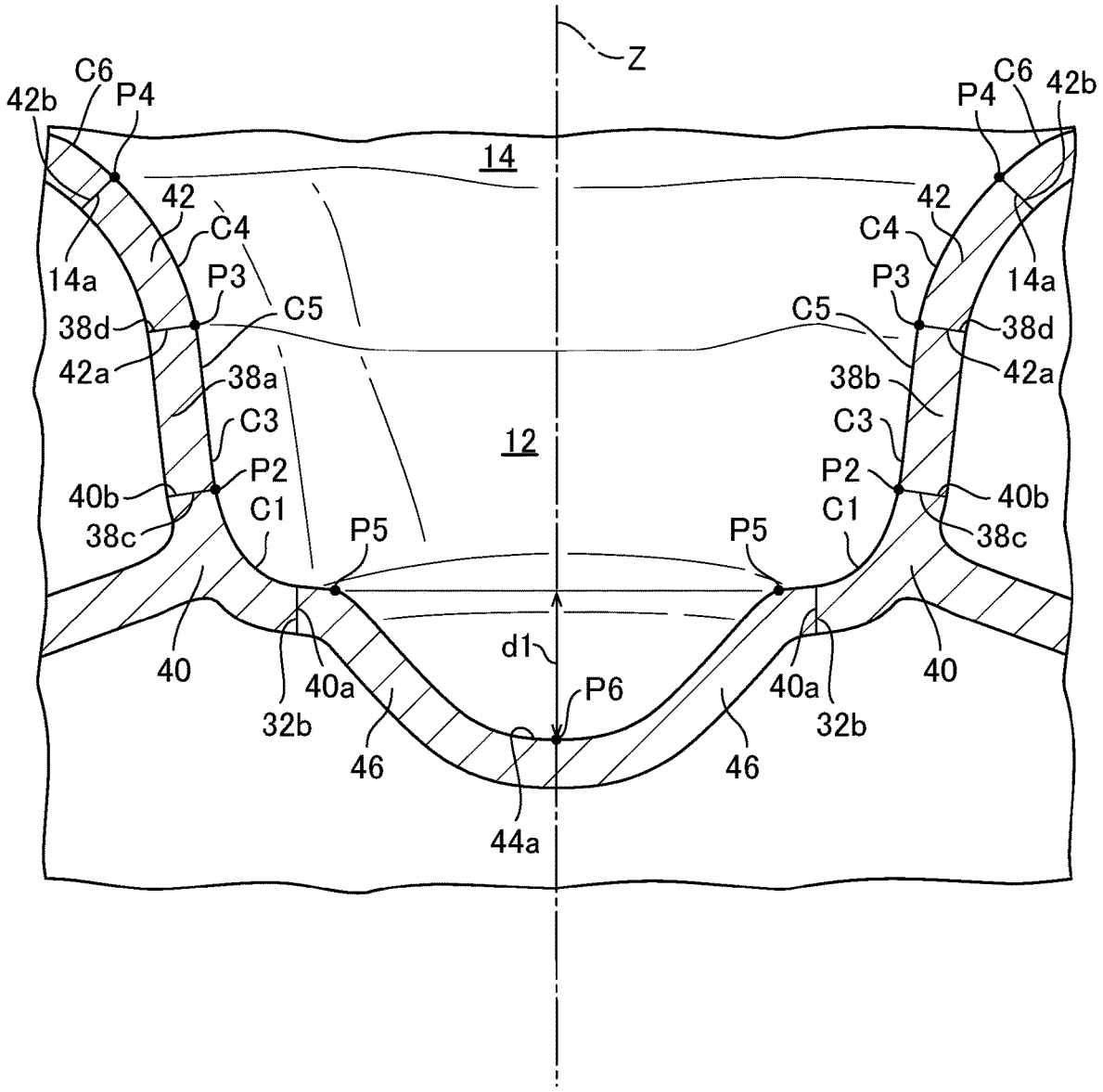
FIG. 8B is a cross-sectional view of an enlarged part of a well portion of a bowl in a toilet main body of a flush toilet according to one embodiment of the present invention shown in FIG. 8A.

Next, as shown in FIGS. 6B, 7B and 8B, the bottom wall 32 of the well portion 12 includes a concave portion 44 formed to recess downward on left and right sides with respect to the center axis Z in the left-right direction in the front sectional view.

Further, as shown in FIGS. 4A to 4C, 6B, 7B and 8B, a transition region 46 where a shape of the bottom wall 32 transits from a side of the lower joining portion 40 toward the concave portion 44 is provided in a region between the lower joining portion 40 and the concave portion 44 on left and right inner sides in the bottom wall 32 of the well portion 12.

The transition region 46 is formed from a flat shape to an upward protruding convex shape as being from the lower joining portion 40 side toward the left and right inner sides, and then formed to transit to a concave shape of the concave portion 44.

Figure 4A:
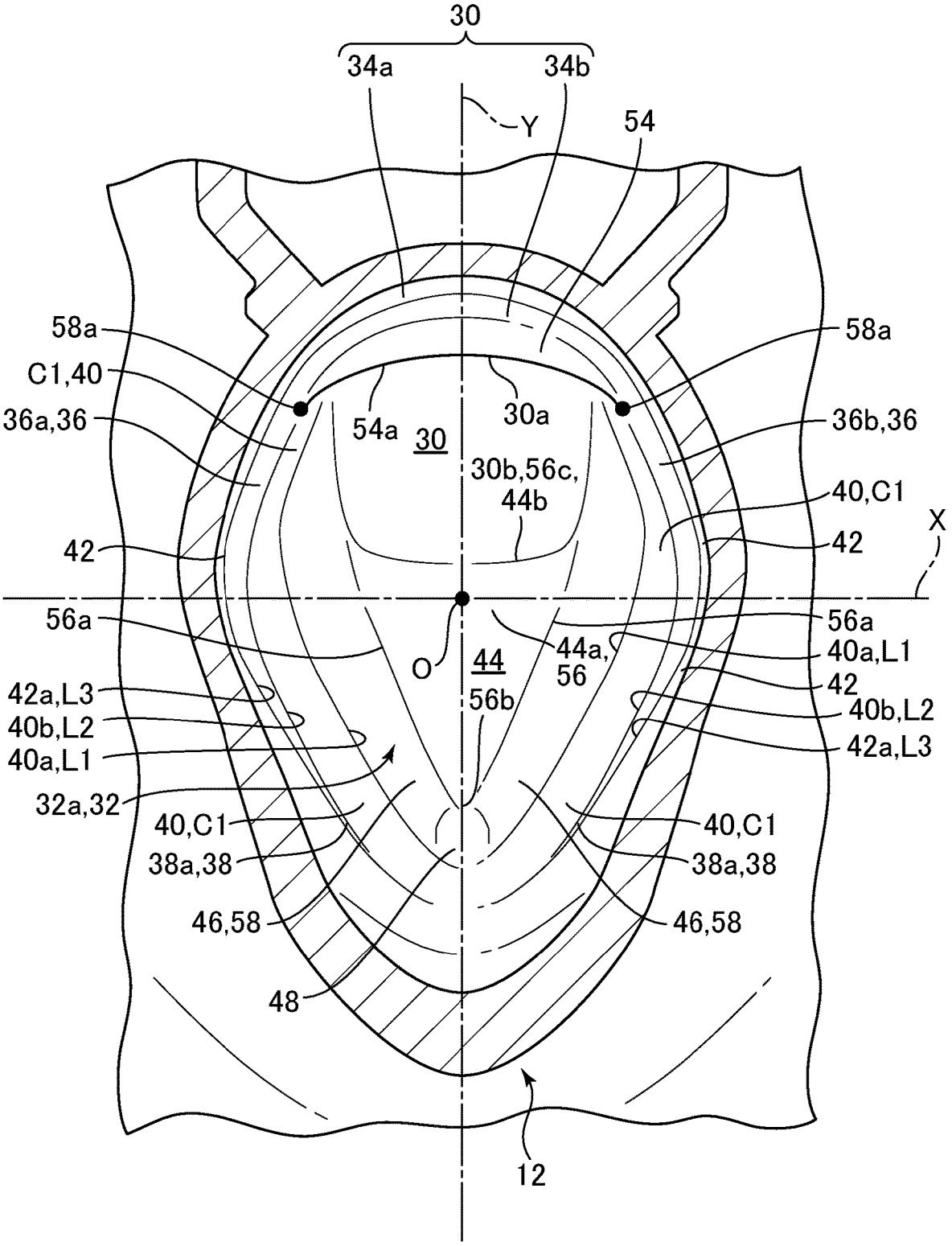
FIG. 4A is a cross-sectional view along the IVA-IVA line of FIG. 2.
Figure 4B:
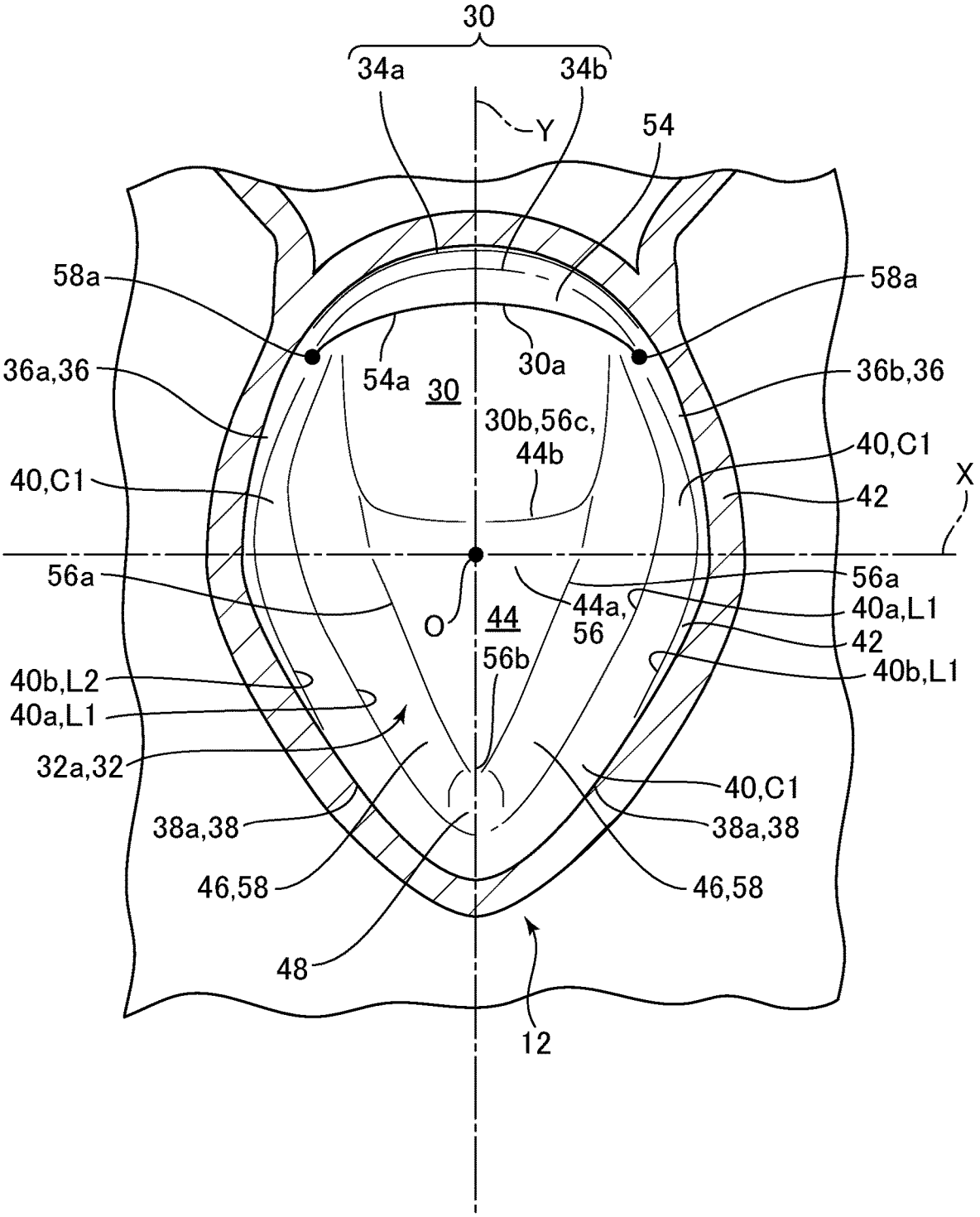
FIG. 4B is a cross-sectional view along the IVB-IVB line of FIG. 2.
Figure 4C:
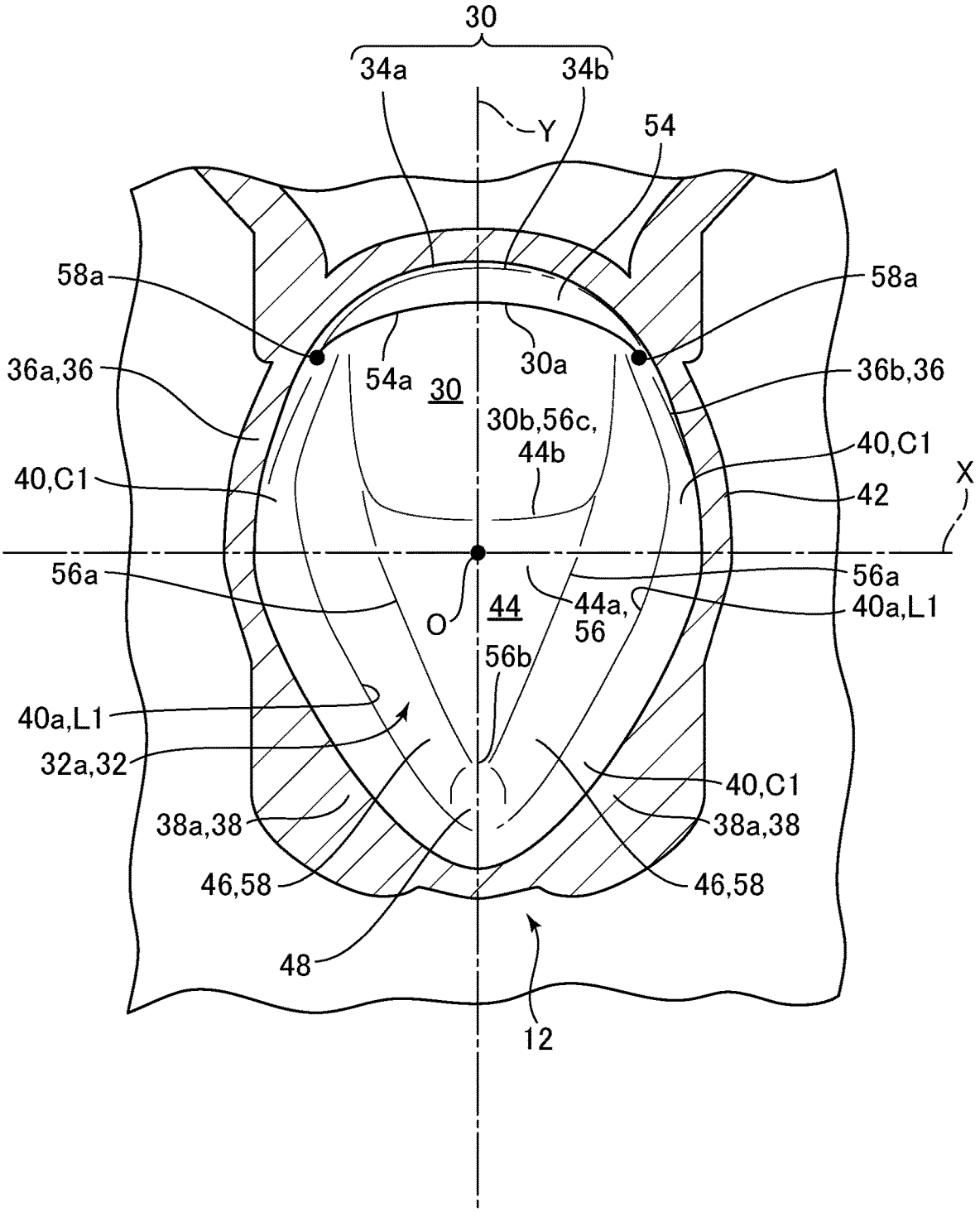
FIG. 4C is a cross-sectional view along the IVC-IVC line of FIG. 2.
Figure 5A:
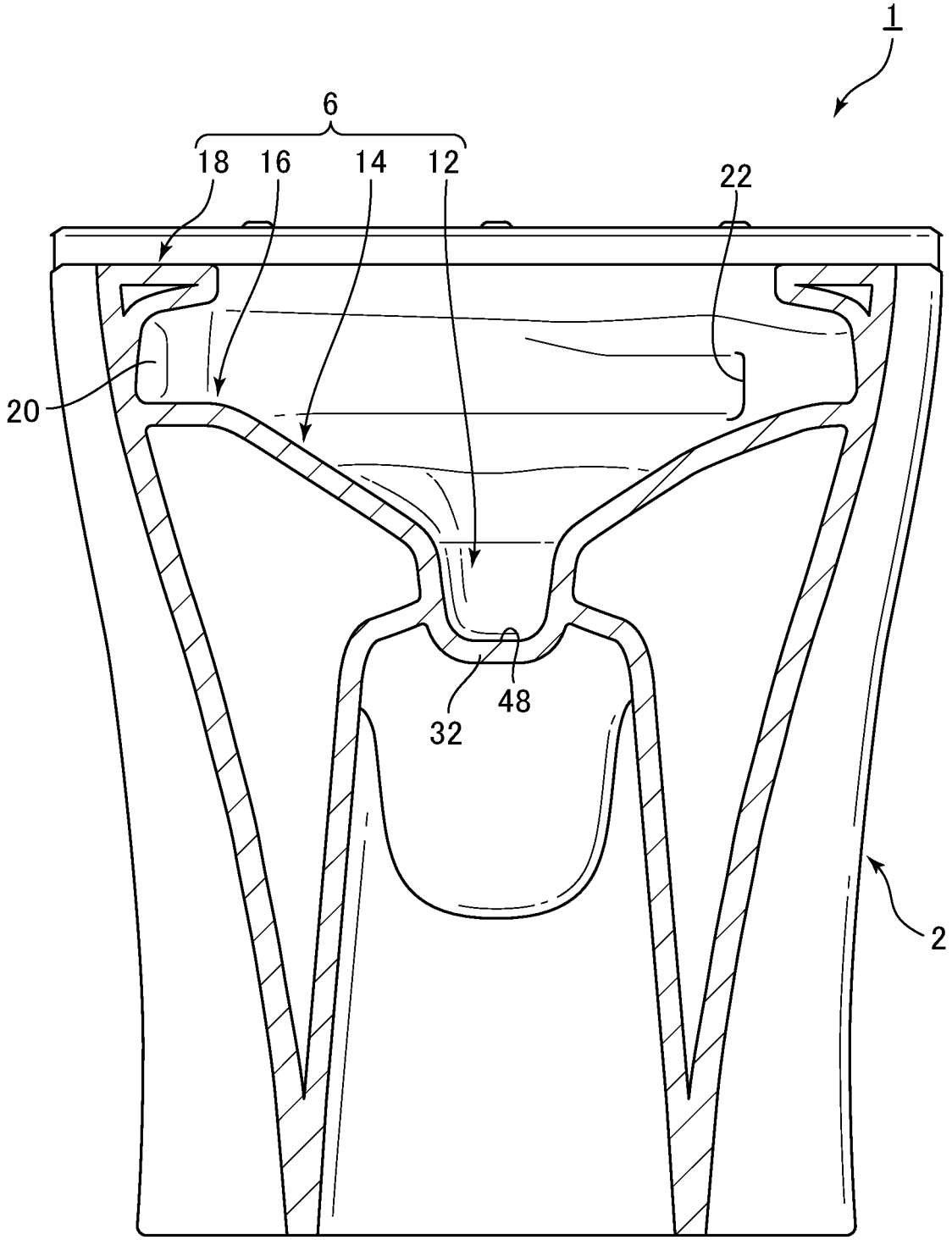
FIG. 5A is a cross-sectional view along the VA-VA line of FIG. 2.
Figure 5B:
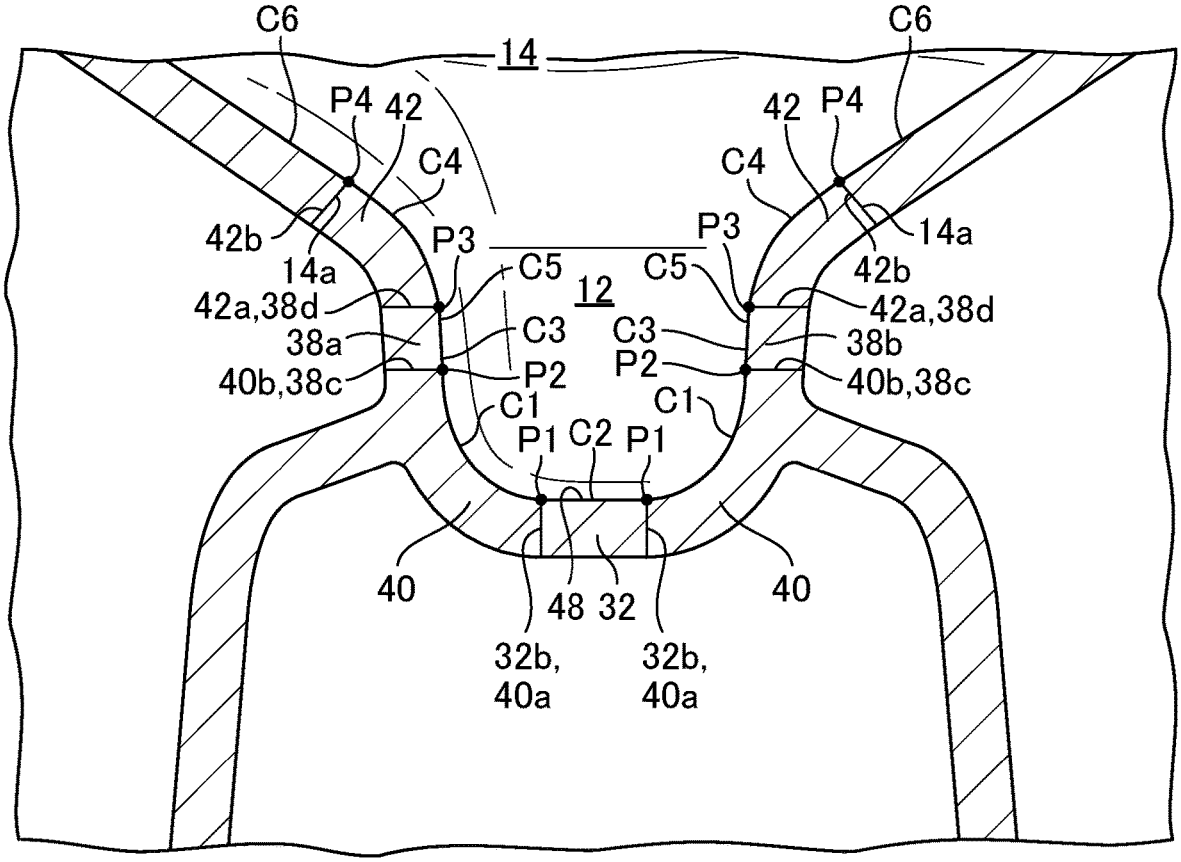
FIG. 5B is a cross-sectional view of an enlarged part of a well portion of a bowl in a toilet main body of a flush toilet according to one embodiment of the present invention shown in FIG. 5A.

Furthermore, as shown in FIGS. 4A to 4C, the concave portion 44 is formed in a fan shape in such a manner that a width of the concave portion in the left-right direction increases toward an inlet 30 side of the rear water discharge trap 8 in a planar view.

Next, as shown in FIGS. 3A, 6B, 7B and 8B, the concave portion 44, in the side sectional view, has a bottom surface 44*a* protruding downward in the front-rear direction and being inclined downward toward the inlet 30 side of the rear water discharge trap 8.

Further, as shown in FIGS. 3A, 4A to 4C and 5B, in the region between the lower joining portion 40 and the concave portion 44 in front of the concave portion 44, a guiding portion 48 formed from a flat shape to an upward protruding convex shape so as to inhibit flush water flowing into the region from excessively flowing into the concave portion 44.

Furthermore, as shown in FIGS. 6B, 7B and 8B, in the concave portion 44, in the front or side sectional view, a concave amount dl in the vertical direction from a top position P5 of a portion formed in a convex shape in the transition region 46 to a lowermost bottom surface position P6 of the concave portion 44 is set to increase toward the inlet 30 side of the rear water discharge trap 8.

Next, as shown in FIGS. 3A and 4A to 4C, the concave portion 44 of the well portion 12 has the bottom surface 44*a* including a rear end 44*b* connected to the inlet 30 of the water discharge trap 8.

In the side sectional view of FIG. 3A, the concave portion 44 of the well portion 12 includes a first tangent line T1 extending in the front-rear direction from the rear end 44*b* along the bottom surface 44*a*, and a first tangential extension T2 of the first tangent line T1 being extended rearward from the rear end 44*b*.

Further, in the side sectional view of FIG. 3A, the water discharge trap 8 forms a trap pipeline 52 extending rearward and downward from the inlet 30 to a lowermost end 50, and then extending rearward and upward from the lowermost end 50.

In the side sectional view of FIG. 3A, the first tangential extension T2 is set to pass a height position lower than a height position of a rear end 30*a* of the inlet 30 of the water discharge trap 8 at the same position in the front-rear direction with respect to the rear end 30*a* of the inlet 30 of the water discharge trap 8.

Further, in the side sectional view of FIG. 3A, the first tangential extension T2 is located in the trap pipeline 52 so as to pass a height position lower than an upper surface 52*a* in the trap pipeline 52 from the inlet 30 of the water discharge trap 8 to the lowermost end 50.

Here, as shown in FIG. 3A, in the trap pipeline 52 from a lower end of a protrusion 54 at the rear end 30*a* of the inlet 30 of the water discharge trap 8 to the lowermost end 50 of the water discharge trap 8, a shape of the upper surface 52*a* in the side sectional view is formed into a substantially flat shape.

Next, in the side sectional view of FIG. 3A, the waste receiving surface 14 includes a second tangent line T3 extending in the front-rear direction along the waste receiving surface 14, and a second tangential extension T4 of the second tangent line T3 being extended rearward from the bottom edge 14*a* of the waste receiving surface 14.

Then, the first tangential extension T2 and the second tangential extension T4 described above are set to be substantially parallel to each other in the side sectional view of FIG. 3A.

Next, as shown in FIGS. 4A to 4C, the rear side wall 36 of the well portion 12 is formed to be located inside the well portion 12 as the wall surfaces of the left and right walls 36*a* and 36*b* in the planar view are from top toward bottom.

Further, as shown in FIGS. 3A and 4A to 4C, the protrusion 54 protruding forward is provided above the rear end 30*a* of the inlet 30 of the water discharge trap 8 in a lower region of the rear walls 34*a* and 34*b* of the well portion 12.

Next, as shown in FIGS. 3A and 4A to 4C, the bottom wall 32 of the well portion 12 includes a central bottom surface 56 including a position of the center O of the well portion 12 in the front-rear direction, and a peripheral bottom surface 58 formed on left and right peripheral edges 56*a* of the central bottom surface 56.

First, the central bottom surface 56 has a central region that forms the concave portion 44 recessed downward from a periphery and that is located downward toward the inlet 30 side of the rear water discharge trap 8.

Further, in the planar view of FIGS. 4A to 4C, the central bottom surface 56 is formed in a fan shape in such a manner that a width of the central bottom surface in the left-right direction increases from a front end 56*b* of the central bottom surface 56 toward a rear end 56*c* (corresponding to a front end 30*b* of the inlet 30 of the rear water discharge trap 8).

Next, the peripheral bottom surface 58 joins the left and right peripheral edges 56*a* of the central bottom surface 56 and the bottom edge 40*a* of the lower joining portion 40 (corresponding to an inner edge of the lower joining portion 40 in the planar view of FIG. 4A to 4C) and is substantially a surface forming the transition region 46 of the bottom wall 32 of the well portion 12.

As shown in FIG. 3A, the peripheral bottom surface 58 is formed at a position higher than the central bottom surface 56, and a rear end 58*a* of the peripheral bottom surface is joined to the protrusion 54.

Thereby, the peripheral bottom surface 58 is located upward from the rear side joined to the protrusion 54 toward the front side in the side sectional view of FIG. 3A.

Next, as shown in FIGS. 4A to 4C, the protrusion 54 is provided at a lower end of the rear wall 34 of the well portion 12 and is provided in an entire region in a left-right width direction at the rear end 30*a* of the inlet 30 of the water discharge trap 8.

Further, as shown in FIGS. 4A to 4C, the protrusion 54 has a front end 54*a* formed in a convex curved shape rearward in the planar view.

Next, as shown in FIG. 3A, the inlet 30 of the water discharge trap 8 includes the rear end 30*a* joined to the lower end of the rear wall 34 of the well portion 12, and the front end 30*b* joined to the left and right central rear ends 56*c* on the central bottom surface 56 of the bottom wall 32 of the well portion 12.

As shown in FIG. 3A, the front end 30*b* of the inlet 30 of the water discharge trap 8 is provided at a position lower than the rear end 30*a* of the inlet 30 of the water discharge trap 8.

Next, description will be made as to flow of flush water in the bowl 6 during toilet flushing in the flush toilet 1 according to one embodiment of the present invention with reference to FIGS. 1 to 10.

Figure 9:
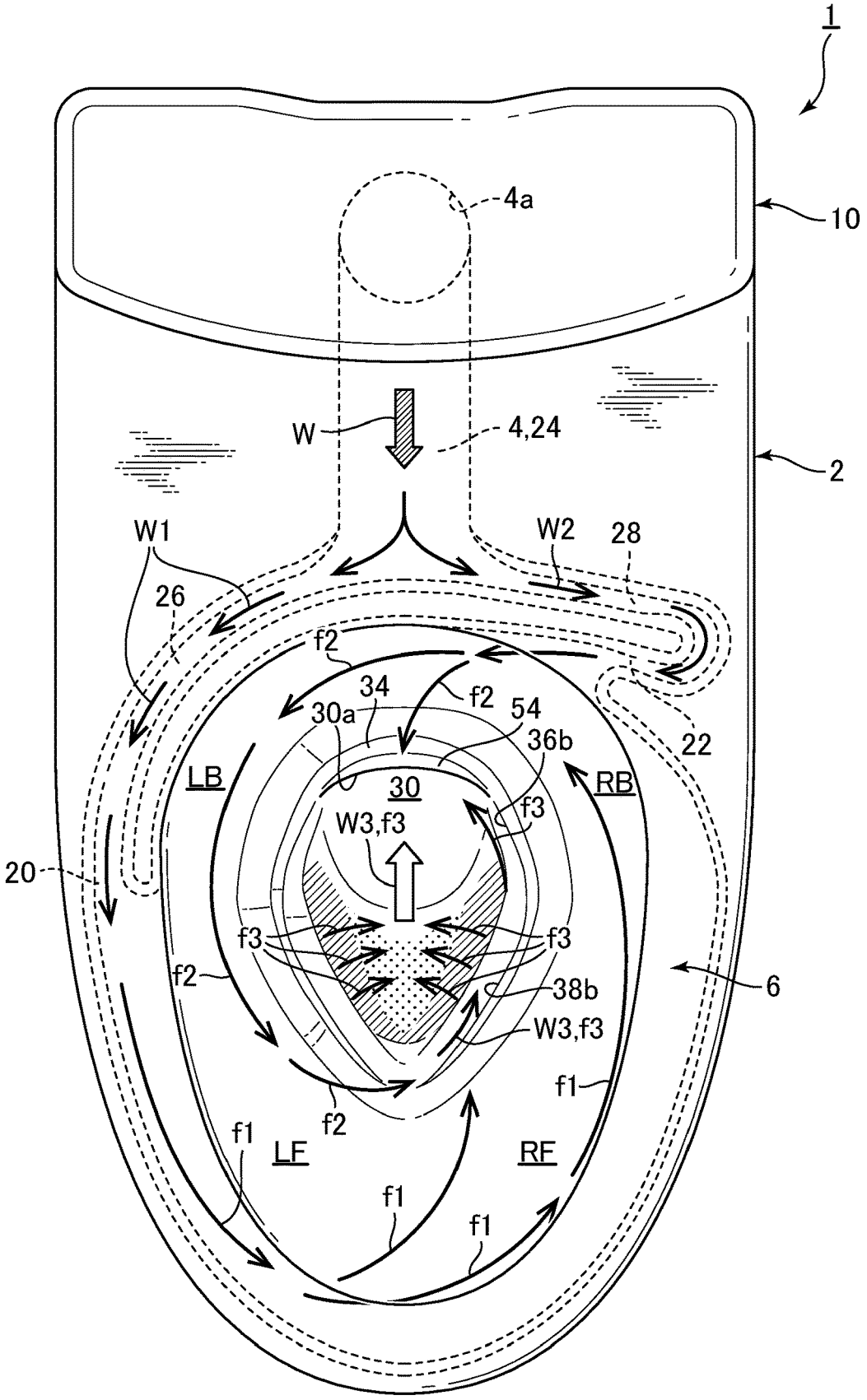
FIG. 9 is a schematic plan view schematically illustrating flow of flush water in a state where flush water spouted through a second rim spouting port in a bowl of a flush toilet according to one embodiment of the present invention circulates from a rear side to a front side of the bowl, and then flows from the front side into a well portion.

First, as shown in FIG. 9, when toilet flushing is started in the flush toilet 1 of the present embodiment, flush water W in the storage tank 10 is supplied to the common conduit 24 from the inlet 4*a* of the water conduit 4 of the toilet main body 2. The flush water W in the common conduit 24 branches as first flush water W1 and second flush water W2 into the first rim conduit 26 and the second rim conduit 28.

Figure 10:
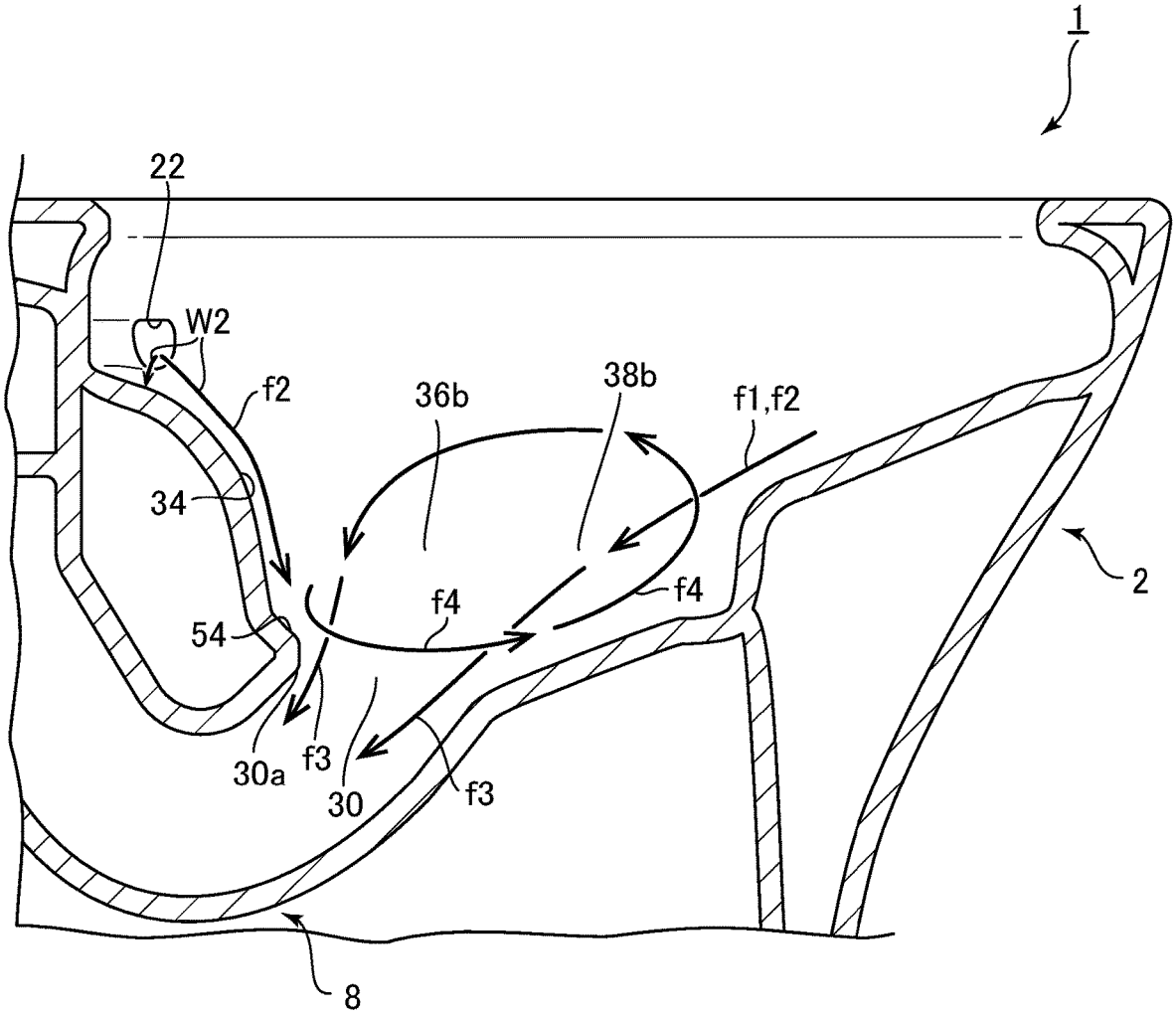
FIG. 10 is a schematic side sectional view schematically illustrating flow of flush water in a state where flush water spouted through the second rim spouting port in the bowl of the flush toilet according to one embodiment of the present invention circulates from the rear side to the front side of the bowl, and then flows from the front side into the well portion.

Next, as shown in FIGS. 9 and 10, the first flush water W1 of the first rim conduit 26 is discharged as first rim spout water W1 forward from the downstream first rim spouting port 20. The first rim spout water W1 forms a circulating flow f1 that circulates from the left front region LF through the right front region RF to the right rear region RB in the bowl 6.

On the other hand, as shown in FIGS. 9 and 10, the second flush water W2 of the second rim conduit 28 is discharged as second rim spout water W2 from the second rim spouting port 22. The second rim spout water W2 forms a flow f2 that circulates from the right rear region RB through the left rear region LB to a left front region LF region in the bowl 6, and then flows from the left front region LF region into the front region in the well portion 12.

Further, part of the second rim spout water W2 discharged from the second rim spouting port 22 flows from the waste receiving surface 14 in a rear region behind the well portion 12 of the bowl 6 into a rear region in the well portion 12.

Next, as shown in FIGS. 9 and 10, flush water W3 flowing into the well portion 12 is collected on a concave portion 44 side of the bottom wall 32 of the well portion 12 (left and right center side) to form a flow f3 of flush water converged from the bottom wall 32 of the well portion 12 toward the inlet 30 of the water discharge trap 8, thereby forming a flow that strongly pushes waste into the water discharge trap 8.

Also, part of the flush water W3 guided to a lower part of the well portion 12 further collides from above with the protrusion 54 provided above the rear end 30*a* of the inlet 30 of the water discharge trap 8 in the lower region of the rear walls 34*a* and 34*b* of the well portion 12.

Thereby, the flush water W3 after the collision splashes upward, forward or the like, so that the flow f3 of the flush water W3 is changed to a flow f4 that generally flows upward.

Then, the flow f4 of flush water forms a flow that circulates in a vertical direction (hereinafter referred to as "the vertical circulating flow f4"), and the waste in the well portion 12 is stirred together with the flush water flowing into the well portion 12 and pooled water of the pooled water portion W0, and then discharged from the inlet 30 of the water discharge trap 8 into the water discharge trap 8.

On the other hand, the flush water W3 flowing from the front waste receiving surface 14 of the well portion 12 along the front side wall 38 in the well portion 12 (in particular, see the front right wall 38*b* in FIGS. 9 and 10) into the rear side wall 36 (in particular, see the rear right wall 36*b* in FIGS. 9 and 10) collides with a wall surface of the rear side wall 36*b*, and is guided downward and rearward along the wall surface of the rear side wall 36*b* in the well portion 12 and flows into the lower ends of the rear walls 34*a* and 34*b* of the well portion 12 and near the rear end 30*a* of the inlet 30 of the water discharge trap 8.

Then, in the flush water W3 flowing into the lower end of the rear wall 34 (34*a*, 34*b*) of the well portion 12 and near the rear end 30*a* of the inlet 30 of the water discharge trap 8, the flush water W3 having a vector of flow directed downward without being directed rearward flows from the inlet 30 of the water discharge trap 8 into the water discharge trap 8 in a state of maintaining the vector of the flow f3.

In the flush toilet 1 of one embodiment of the present invention described above, in the front sectional view of FIGS. 6B, 7B and 8B, the bottom wall 32 of the well portion 12 forms the concave portion 44 so as to recess downward on the left and right sides with respect to the left-right center axis Z, and hence the flush water W3 around the pooled water portion W0 in the well portion 12 is collected on the concave portion 44 side (left-right center side) of the bottom wall 32 of well portion 12 (see FIGS. 6B, 7B, 8B and 9).

Thereby, in the flush water W3 in the well portion 12, the flow f3 of flush water converged from the bottom wall 32 of the well portion 12 toward the inlet 30 of the water discharge trap 8 can be formed (see FIGS. 9 and 10).

In addition, since the left-right center of the bottom wall 32 of the well portion 12 is recessed downward by the concave portion 44, waste that falls in a position of the pooled water portion W0 shifted in the left-right direction can be collected in the center, and waste that falls in a center of the pooled water portion W0 can be also smoothly guided, together with the flush water W3 flowing into the well portion 12, toward the inlet 30 of the water discharge trap 8.

As a result, even if an entire pooled water region of the pooled water portion W0 is secured large to a certain extent, adhesion of waste to an interior of the bowl 6 (in particular, the well portion 12) can be prevented, and decrease in flushing performance and waste discharge performance can be prevented.

Further, in the flush toilet 1 of the present embodiment, when the flush water W3 that forms the vertical circulating flow f4 in the well portion 12 circulates around once in the vertical direction and then flows into the concave portion 44, the flush water is guided to the inlet 30 of the water discharge trap 8 along the concave portion 44 located below toward the inlet 30 side of the rear water discharge trap 8.

Thereby, the waste in the well portion 12 can be stirred by the vertical circulation and then effectively pushed into the water discharge trap 8.

As a result, the waste discharge performance of the flush toilet 1 can be further effectively improved.

Furthermore, in the flush toilet 1 of the present embodiment, as shown in FIGS. 6B, 7B and 8B, in the front sectional view of the bottom wall 32 of the well portion 12, the transition region 46 is provided in the region between the joining portion 40 and the concave portion 44, the joining portion 40 joining the outer edge 32*b* of the bottom surface 32*a* of the bottom wall 32 of the well portion 12 and the bottom edge 36*c*, 38*c* of the side wall 36, 38 with the surface C1 having the curvature. Thereby, the bottom wall 32 of the well portion 12 is formed from the flat shape to the upward protruding convex shape as being from the joining portion 40 side toward the left and right inner sides, and then transits to the concave shape of the concave portion 44.

Thereby, the flush water W3 in left and right outer regions of the concave portion 44 in the pooled water portion W0 flows into the concave portion 44 over the convex portion protruding upward from the flat shape in the transition region 46. In this state, convex portions on left and right outer sides of the concave portion 44 inhibit the flush water from flowing out of the concave portion 44 again.

Thereby, while maintaining a state where the flush water W3 is held in the concave portion 44, the flow f3 of the flush water converged toward the inlet 30 of the water discharge trap 8 can be formed.

Therefore, the flush water and waste flowing into the pooled water portion W0 of the well portion 12 can be reliably guided toward the inlet 30 of the water discharge trap 8.

Further, in the flush toilet 1 of the present embodiment, as shown in FIG. 3A, in the side sectional view of the well portion 12, the concave portion 44 is inclined downward toward the inlet 30 side of the rear water discharge trap 8. Therefore, the whole concave portion 44 can be formed into a shape pointing toward the inlet 30 of the water discharge trap 8 on the rear side.

Therefore, when the flush water and waste flowing into the pooled water portion W0 of the well portion 12 flows into the concave portion 44, these flush water and waste do not stay in the pooled water portion W0 and can be smoothly directed to the inlet 30 of the water discharge trap 8.

Therefore, both flushing performance (flushing power) and waste discharge performance (discharge power) in the flush toilet 1 can be improved.

Furthermore, in the flush toilet 1 of the present embodiment, as shown in FIGS. 4A and 4B, in the planar view of the concave portion 44 of the well portion 12, the concave portion 44 is formed in the fan shape in such a manner that the width of the concave portion in the left-right direction increases toward the inlet 30 side of the water discharge trap 8 on the rear side.

Thereby, the flush water W3 and waste flowing into the pooled water portion W0 of the well portion 12 flows into the concave portion 44, and then the waste can be guided in a wide range of the inlet 30 of the water discharge trap 8 on the rear side of the concave portion 44.

In addition, when the flush water W3 and waste flowing rearward out of the concave portion 44 flow into the inlet 30 of the water discharge trap 8, a strong pushing force can be generated over an entire region of the inlet 30 of the water discharge trap 8, so that the waste guided to the entire region of the inlet 30 of the water discharge trap 8 can be inhibited from being clogged in the trap pipeline 52 of the water discharge trap 8.

Therefore, both the flushing performance (flushing power) and the waste discharge performance (discharge power) in the flush toilet 1 can be more effectively improved.

Furthermore, in the flush toilet 1 of the present embodiment, the concave portion 44 of the central bottom surface 56 of the well portion 12 is formed in such a manner that a left-right width of the concave portion 44 increases, as being from the front end 56*b* toward the front end 30*b* of the inlet 30 of the water discharge trap 8 on the rear side.

Thereby, in the flush water W3 forming the vertical circulating flow f4 in the well portion 12, the flush water circulating around once in the vertical direction and then flowing into the concave portion 44 can be guided in the wide range of the inlet 30 of the rear water discharge trap 8 along the concave portion 44.

Thereby, the flush water W3 including the waste stirred by the vertical circulating flow f4 in the well portion 12 can form the flow f3 that pushes with a strong pushing force over the entire region of the inlet 30 of the water discharge trap 8.

As a result, the trap pipeline 52 of the water discharge trap 8 can be inhibited from being clogged with the waste guided to the entire region of the inlet 30 of the water discharge trap 8, and hence the waste discharge performance (discharge power) in the flush toilet 1 can be more effectively improved.

Further, in the flush toilet 1 of the present embodiment, the bottom surface 44*a* of the concave portion 44 of the well portion 12 protrudes downward in the front-rear direction in the side sectional view of FIG. 3A, so that a concave surface extending in the front-rear direction can be formed.

Thereby, the flush water and waste in the concave portion 44 flow, to the inlet 30 side of the water discharge trap 8, along the concave surface extending in the front-rear direction and are accordingly guided to the inlet 30 of the water discharge trap 8 with a strong flux, so that the flush water and waste can flow reliably into the water discharge trap 8.

Therefore, both the flushing performance (flushing power) and the waste discharge performance (discharge power) in the flush toilet 1 can be further effectively improved.

Furthermore, in the flush toilet 1 of the present embodiment, as shown in FIGS. 3A, 6B, 7B and 8B, in the front sectional or side sectional view of the concave portion 44 of the well portion 12, the concave amount d1 in the vertical direction from the top position P5 of the portion formed in the convex shape in the transition region 46 to the lowermost bottom surface position P6 of the concave portion 44 is set to increase toward the inlet 30 side of the rear water discharge trap 8.

Thus, the flush water W3 and waste in the concave portion 44 can be inhibited from flowing to the outside of the concave portion 44 over the flat or upward protruding convex portion in the transition region 46.

Thereby, the flow f3 of the flush water W3 converged toward the inlet 30 of the water discharge trap 8 can be formed while maintaining the state where the flush water is held in the concave portion 44.

Further, the flush water W3 and waste flowing into the pooled water portion W0 of the well portion 12 can be reliably guided toward the inlet of the water discharge trap by the flow f3 of the converged flush water formed in the concave portion 44.

Further, in the flush toilet 1 of the present embodiment, part of the flush water W1, W2 discharged into the bowl 6 from each of the first rim spouting port 20 and the second rim spouting port 22 that are water spouting parts circulates on the waste receiving surface 14 to the front side of the well portion 12, and then flows from the front side of the well portion 12 into the well portion 12.

At this time, part of the flush water W3 flowing into the region between the joining portion 40 and the concave portion 44 in front of the concave portion 44 of the well portion 12 collides with the guiding portion 48 formed in the flat shape or the upward protruding convex shape, so that the flow f3 that does not flow into the concave portion 44 but is guided and circulates in the circumferential direction of the well portion 12 can be formed.

Therefore, the flush water W3 flowing into the pooled water portion W0 in the well portion 12 is inhibited from excessively flowing into the concave portion 44, so that the flow f3 circulating in the well portion 12 can be secured, and the flow of pushing from the concave portion 44 into the inlet 30 of the water discharge trap 8 can be secured.

Consequently, since both the flushing performance (flushing power) and the waste discharge performance (discharge power) in the well portion 12 of the bowl 6 in the flush toilet 1 can be achieved, overall flushing performance of the flush toilet 1 can be improved.

Furthermore, in the flush toilet 1 of the present embodiment, as shown in FIG. 3A, in the side sectional view of the concave portion 44 of the well portion 12 and the water discharge trap 8, the first tangential extension T2, in which the first tangent line T1 extending from the rear end 44*b* of the bottom surface 44*a* of the concave portion 44 along the bottom surface 44*a* in the front-rear direction is further extended rearward, can be positioned in the trap pipeline 52 so as to pass the height position below the upper surface 52*a* in the trap pipeline 52 from the inlet 30 of the water discharge trap 8 to the lowermost end 50.

Thereby, when the flush water W3 and waste flowing into the pooled water portion W0 of the well portion 12 flow into the concave portion 44, these flush water W3 and waste do not stay in the pooled water portion W0 and can be directed smoothly from the inlet 30 of the water discharge trap 8 into an interior of the water discharge trap 8.

Therefore, both the flushing performance (flushing power) and the waste discharge performance (discharge power) in the flush toilet 1 can be effectively improved.

Also, in the flush toilet 1 of the present embodiment, the flush water W3 including the waste flowing from the front region in the well portion 12 along the bottom surface 32*a* of the bottom wall 32 (the bottom surface 44*a* of the concave portion 44) around the front end 30*b* of the inlet 30 of the water discharge trap 8 flows toward the water discharge trap 8 on the rear side.

At this time, in the side sectional view of FIG. 3A, the first tangential extension T2 of the first tangent line T1 in the bottom surface 32*a* of the bottom wall 32 of the well portion 12 (the bottom surface 44*a* of the concave portion 44) is set to pass the height position lower than the height position of the rear end 30*a* of the inlet 30 of the water discharge trap 8 at the same position in the front-rear direction with respect to the rear end 30*a* of the inlet 30 of the water discharge trap 8.

Thereby, the flush water W3 smoothly passes the rear end 30*a* of the inlet 30 of the water discharge trap 8 without stagnating and can smoothly flow into the water discharge trap 8.

Therefore, the waste in the bowl 6 can be smoothly guided to the water discharge trap 8, and hence the waste discharge performance (discharge power) in the flush toilet 1 can be improved.

Furthermore, in the flush toilet 1 of the present embodiment, part of the flush water W1, W2 discharged into the bowl 6 from each of the first rim spouting port 20 and the second rim spouting port 22 that are the water spouting parts circulates on the waste receiving surface 14 to the front side of the well portion 12, and then flows from the front side of the well portion 12 into the well portion 12 (see the flow f1 of the flush water W1, W3 of FIGS. 9 and 10).

Then, the flush water W3 flowing from the waste receiving surface 14 above and in front of the well portion 12 into the front region in the well portion 12 is guided from the front region of the well portion 12 along the bottom surface 32*a* of the bottom wall 32 of the well portion 12 (the bottom surface 44*a* of the concave portion 44) toward the front end 30*b* side of the inlet 30 of the water discharge trap 8 that is joined to the rear end 44*b* at the center in the left-right direction.

At this time, as shown in FIG. 3A, since the front end 30*b* of the inlet 30 of the water discharge trap 8 is provided at the position lower than the rear end 30*a* of the inlet 30 of the water discharge trap 8, a structure having a height difference between a low front side and a high rear side in the inlet 30 of the water discharge trap 8 can be obtained.

Thus, when the flush water W3 including the waste flowing from the front region in the well portion 12 and near the front end 30*b* of the inlet 30 of the water discharge trap 8 flows toward the water discharge trap 8 on the rear side, the flush water can smoothly pass at the rear end 30*a* of the inlet 30 of the water discharge trap 8 without stagnating and can smoothly flow into the water discharge trap 8.

Therefore, since the waste in the bowl 6 can be smoothly guided to the water discharge trap 8, the waste discharge performance (discharge power) in the flush toilet 1 can be improved.

Further, in the flush toilet 1 of the present embodiment, part of the flush water W1, W2 discharged into the bowl 6 from each of the first rim spouting port 20 and the second rim spouting port 22 that are the water spouting parts circulates on the waste receiving surface 14 to the front side of the well portion 12, and then flows from the front side of the well portion 12 into the well portion 12 (see the flow f3 of the flush water W3 in FIG. 9).

At this time, the flush water W3 flowing from the front waste receiving surface 14 above and in front of the well portion 12 along the front side wall 38 in the well portion 12 (in particular, see the front right wall 38*b* in FIGS. 9 and 10) into the rear side wall 36 (in particular, see the rear right wall 36*b* in FIGS. 9 and 10) is guided along the wall surfaces of the left and right rear walls 36*a* and 36*b* located inside the well portion 12 to the lower part of the well portion 12 as being from top toward bottom in the planar view of the rear side wall 36 shown in FIGS. 4A to 4C.

Then, the flush water W3 guided to the lower part of the well portion 12 further collides from above with the protrusion 54 provided above the rear end 30*a* of the inlet 30 of the water discharge trap 8 in the lower region of the rear wall 34*a*, 34*b* of the well portion 12.

Also, the flush water W3 after the collision splashes upward, forward or the like, and the flow f3 of the flush water W3 is accordingly changed to the overall upward flow f4.

Thereby, the flow f3 of flush water forms the vertically circulating flow (vertical circulating flow f4), and the waste in the well portion 12 is stirred together with the flush water flowing into the well portion 12 and the pooled water of the pooled water portion W0 and is then discharged from the inlet 30 of the water discharge trap 8 into the water discharge trap 8.

Therefore, the flush water W3 and pooled water including the waste in the well portion 12 can be easily stirred, and hence the waste discharge performance of the flush toilet 1 can be improved.

Furthermore, in the flush toilet 1 of the present embodiment, in the flush water W1, W2 discharged into the bowl 6 from each of the first rim spouting port 20 and the second rim spouting port 22 which are the water spouting parts, the flush water W3 flowing from the waste receiving surface 14 in front of the well portion 12 along the front side wall 38 in the well portion 12 (in particular, see the front right wall 38*b* in FIGS. 9 and 10) into the rear side wall 36 (in particular, see the rear right wall 36*b* in FIGS. 9 and 10) collides with the wall surface of the rear side wall 36*b*, is then guided downward and rearward in the well portion 12 along the wall surface of the rear side wall 36*b* and flows into the lower ends of the rear walls 34*a* and 34*b* of the well portion 12 and near the rear end 30*a* of the inlet 30 of the water discharge trap 8.

Then, in the flush water W3 flowing into the lower end of the rear wall 34 (34*a*, 34*b*) of the well portion 12 and near the rear end 30*a* of the inlet 30 of the water discharge trap 8, the flush water W3 having a vector of flow directed downward without being directed rearward flows from the inlet 30 of the water discharge trap 8 into the water discharge trap 8 while maintaining the vector of the flow f3.

On the other hand, in the flush water W3 flowing into the lower end of the rear wall 34 (34*a*, 34*b*) of the well portion 12 and near the rear end 30*a* of the inlet 30 of the water discharge trap 8, the flush water W3 having the vector of rearward flow collides from above with the protrusion 54 provided above the rear end 30*a* of the inlet 30 of the water discharge trap 8 in the lower region of the rear wall 34 (34*a*, 34*b*) of the well portion 12, and splashes upward, forward or the like.

Thereby, the flow f3 of flush water is changed to an overall upward and forward flow, and the vertical circulating flow f4 is formed in the well portion 12.

Further, the flush water W3 of the vertical circulating flow f4 in the well portion 12 circulates once in the vertical direction and then forms the flow f3 directed from the inlet 30 of the water discharge trap 8 into the water discharge trap 8. After stirring the waste in the well portion 12 by the vertical circulating flow f4, the waste can be pushed by the flow f3 pushing into the water discharge trap 8.

As a result, the waste discharge performance of the flush toilet 1 can be further effectively improved.

Further, in the flush toilet 1 of the present embodiment, the shape of the upper surface 52*a* in the trap pipeline 52 from the protrusion 54 provided above the rear end 30*a* of the inlet 30 in the water discharge trap 8 to the lowermost end 50 behind and below the protrusion is a substantially flat shape.

Thereby, when the flush water W3 flowing from the front region in the well portion 12 along the bottom surface 32*a* of the bottom wall 32 (the bottom surface 44*a* of the concave portion 44) to the rear side flows from the inlet 30 of the water discharge trap 8 into the trap pipeline 52, the flush water is smoothly guided along an interior of the trap pipeline 52 from the protrusion 54 above the rear end 30*a* of the inlet 30 of the water discharge trap 8 to the lowermost end 50 of the trap pipeline 52 to a downstream side.

At this time, the flush water W3 flowing in the trap pipeline 52 from the protrusion 54 to the lowermost end 50 behind and below the protrusion smoothly flows along the upper surface 52*a* with the substantially flat shape in the side sectional view of the trap pipeline 52 shown in FIGS. 3A and 10, so that pressure loss can be inhibited from being caused due to collision of the flush water W3 with the upper surface 52*a* in the trap pipeline 52 from the protrusion 54 to the lowermost end 50 behind and below the protrusion.

As a result, since the waste in the bowl 6 can be smoothly discharged from the water discharge trap 8, the waste discharge performance (discharge power) in the flush toilet 1 can be improved.

Furthermore, in the flush toilet 1 of the present embodiment, as shown in FIG. 3A, the width H1 of the joining portion 42 that joins the upper edge 36*d*, 38*d* of the side wall 36, 38 of the well portion 12 and the bottom edge 14*a* of the waste receiving surface 14 with the surface C1 having the curvature is set to decrease from the rear side to the front side.

Thereby, the well portion 12 and the waste receiving surface 14 can be brought closer to each other in the vertical direction as being from the rear side toward the front side.

Therefore, in particular, for the waste in the front region on the waste receiving surface 14, part of the flush water W1, W2 spouted on the waste receiving surface 14 from each of the first rim spouting port 20 and the second rim spouting port 22 that are the water spouting parts can be efficiently conveyed to the front region in the well portion 12, and hence the flushing performance (flushing power) and the waste discharge performance (discharge power) in the flush toilet 1 can be improved.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a bowl including a waste receiving surface having a bowl shape, a rim formed on an upper end of the waste receiving surface, and a well portion provided below the waste receiving surface so as to form a pooled water portion;

a water spouting part provided on the rim, the water spouting part being configured to spout flush water toward the bowl; and a water discharge trap including an inlet connected to a lower part of the well portion so as to discharge waste in the bowl, wherein the well portion includes a bottom wall, a side wall, and a joining portion, the bottom wall being formed above and in front of the inlet of the water discharge trap, the side wall being formed to surround a periphery of the bottom wall, and the joining portion being configured to join an outer edge of the bottom wall and a bottom edge of the side wall with a surface having a curvature, and the bottom wall of the well portion includes a concave portion above and in front of a bottom wall of the inlet of the water discharge trap, the concave portion being formed to recess downward on left and right sides with respect to a center axis in a left-right direction in a front sectional view.

2. The flush toilet according to claim 1, further comprising a transition region where a shape of the bottom wall transits from a joining portion side toward the concave portion, the transition region being provided in a region between the joining portion and the concave portion on left and right inner sides in the front sectional view, and the transition region is formed in a flat shape or an upward protruding convex shape as being from the joining portion side toward the left and right inner sides, and then formed to transit to a concave shape of the concave portion.

3. The flush toilet according to claim 1, wherein in a side sectional view, the concave portion is inclined downward as being toward an inlet side of the water discharge trap on a rear side of the concave portion.

4. The flush toilet according to claim 1, wherein in a planar view, the concave portion is formed in a flared configuration in such a manner that a width of the concave portion in the left-right direction increases toward the inlet side of the water discharge trap on a rear side of the concave portion.

5. The flush toilet according to claim 1, wherein in a side sectional view, the concave portion has a bottom surface protruding downward in a front-rear direction.

6. The flush toilet according to claim 2, wherein in the concave portion, in a front sectional view or side sectional view, a concave amount in a vertical direction from a top of a portion formed in a convex shape in the transition region to a lowermost bottom surface of the concave portion is set to increase toward the inlet side of the water discharge trap on a rear side.

7. The flush toilet according to claim 1, wherein in a region between the joining portion and the concave portion in front of the concave portion, a guiding portion formed in a flat shape or an upward protruding convex shape is provided so as to inhibit the flush water flowing into the region from excessively flowing into the concave portion.

8. The flush toilet according to claim 1, wherein in a side sectional view, the concave portion has a bottom surface including a rear end connected to the inlet of the water discharge trap, a tangent line extending from the rear end along the bottom surface in a front-rear direction, and a tangential extension of the tangent line extended rearward from the rear end of the bottom surface, in the side sectional view, the water discharge trap forms a trap pipeline extending rearward and downward from the inlet to a lowermost end and then extending rearward and upward from the lowermost end, and in the side sectional view, the tangential extension is located in the trap pipeline to pass a height position below an upper surface in the trap pipeline from the inlet of the water discharge trap to the lowermost end.

9. The flush toilet according to claim 1, wherein a front end of the inlet of the water discharge trap is provided at a position lower than a rear end of the inlet of the water discharge trap.

10. The flush toilet according to claim 1, wherein the well portion includes a bottom wall formed above and in front of the inlet of the water discharge trap, a rear wall provided on a rear side of the inlet of the water discharge trap, rear side walls provided so as to extend forward from left and right ends of the rear wall to left and right outer sides, and front side walls provided forward from left and right front ends of the rear side walls to narrow on left and right inner sides, the front side walls having front ends joined to each other, in the rear side walls, left and right wall surfaces in a planar view are formed to be located on an inner side of the well portion as being from top to bottom, and a protrusion protruding forward is provided over a rear end of the inlet of the water discharge trap in a lower region of the rear wall.

11. The flush toilet according to claim 10, wherein the protrusion is provided in an entire region in a left-right width direction in a lower end of the rear wall of the well portion and a rear end of the inlet of the water discharge trap, and a front end of the protrusion in a planar view is formed in a rearward convex curved shape.

12. The flush toilet according to claim 1, wherein in a side sectional view, the water discharge trap includes a protrusion provided over a rear end of the inlet of the water discharge trap, the protrusion protruding forward, and a trap pipeline extending rearward and downward from the protrusion to a lowermost end and then extending rearward and upward from the lowermost end, and in the trap pipeline from the protrusion to the lowermost end of the water discharge trap, an upper surface shape in the side sectional view is formed in a substantially flat shape.

13. The flush toilet according to claim 1, wherein the bowl further includes a joining portion that joins a top edge of the side wall of the well portion and a bottom edge of the waste receiving surface with a surface having a curvature, and a vertical width of the joining portion in a side sectional view is set to decrease from a rear side toward a front side.

* * * * *